US005816392A

United States Patent [19]

Kawagoe et al.

[11] Patent Number: 5,816,392

[45] Date of Patent: Oct. 6, 1998

[54] PHOTOGRAPHIC FILM AND PRINT ORGANIZER

[75] Inventors: Hiroaki Kawagoe; Zenya Tanabe; Takuya Arai; Noriko Katayama, all of Tokyo, Japan

[73] Assignee: Fuji Photo Film Co., Ltd., Kanagawa, Japan

[21] Appl. No.: 546,194

[22] Filed: Oct. 20, 1995

[30] Foreign Application Priority Data

| | | | |
|---|---|---|---|
| Oct. 20, 1994 | [JP] | Japan | 6-255740 |
| Oct. 20, 1994 | [JP] | Japan | 6-255741 |
| Oct. 20, 1994 | [JP] | Japan | 6-255742 |
| Oct. 20, 1994 | [JP] | Japan | 6-255743 |

[51] Int. Cl.[6] ..... B65D 85/00

[52] U.S. Cl. ..... 206/232; 206/455

[58] Field of Search ..... 206/232, 455, 206/456, 341, 306.1; 229/68.1, 70, 72; 40/703, 704, 777, 778

[56] References Cited

U.S. PATENT DOCUMENTS

| | | | |
|---|---|---|---|
| 1,317,946 | 10/1919 | Snively | 40/778 |
| 2,193,296 | 3/1940 | Pienzak | 40/771 |
| 2,333,798 | 11/1943 | Kner | 229/67.4 |
| 4,047,661 | 9/1977 | Klein | 229/72 |
| 4,966,285 | 10/1990 | Otake et al. | 206/455 |
| 5,251,744 | 10/1993 | Dziersk et al. | 206/232 |
| 5,251,745 | 10/1993 | Repp et al. | 206/232 |
| 5,251,746 | 10/1993 | Gresh et al. | 206/232 |
| 5,251,747 | 10/1993 | Hansen et al. | 206/232 |
| 5,263,579 | 11/1993 | Blackman | 206/232 |
| 5,303,825 | 4/1994 | Hansen et al. | 206/232 |

*Primary Examiner*—Jimmy G. Foster

*Attorney, Agent, or Firm*—Sughrue, Mion, Zinn, Macpeak & Seas, PLLC

[57] ABSTRACT

A photographic film and print organizer for storing an integral set of an index print sheet, prints and a film cartridge comprises a receptacle for carrying the index print sheet thereon, a retainer for retaining the index print sheet onto the receptacle, and a cartridge holder for holding the film cartridge, the cartridge holder being made as an integral part of the receptacle.

9 Claims, 39 Drawing Sheets

PHOTOGRAPHIC FILM AND PRINT ORGANIZER

BACKGROUND OF THE INVENTION

1. Field of the Invention

The present invention relates to a photographic film and print organizer for storage of a film cartridge containing a roll of exposed and developed film, prints made from frames of the exposed and developed film, and an index print sheet on which miniature pictures are printed from all frames of the negative film.

2. Description of the Related Art

Conventionally, there are various containers or receptacles for storage of a film cartridge containing a roll of exposed and developed film and an index print sheet on which miniature pictures are printed from all frames of the film. U.S. Pat. Nos. 5,251,744 and 5,251,747 describe such a container which comprises an index print sheet mount and a film cartridge case provided separately and attached to the index print sheet mount.

Japanese patent application No. 6-28024, which is filed by the same applicant as this application, describes a cylindrical container made of a paper sheet for receiving prints and a film cartridge. Further, Japanese patent application No. 6-30214, which also is filed by the same applicant as this application, describes a cylindrical container which comprises an index print sheet mount and a film cartridge holder formed by curling a strip as an integral part of the index print sheet mount and tucking or attaching one end of the strip to the index print sheet mount.

While these film and print containers are convenient for storage of prints and a film cartridge containing a roll of film from which the prints are made, nevertheless, various constraints must be imposed on use of these containers. For instance, the containers described in U.S. Pat. Nos. 5,251,744 and 5,251,747 are intended only to receive an index print sheet and a film cartridge which are returned to the customer from a photoshop and have no receptacles for prints made simultaneously with development of the film. Accordingly, the containers cannot be used as an organized container for enclosing an integral set of an index print sheet, prints and a film cartridge and returning them all at once to the customer. Similarly, since the container described in Japanese patent application No. 6-28024 has no receptacle for an index print sheet, it is inconvenient for returning an index print sheet, prints and a film cartridge enclosed as an integral set in a single container. Further, these containers are somewhat difficult to assemble and render it difficult to take film cartridges out of the cartridge holders. In addition, when storing a stack of a number of the containers having cartridge holders integrally formed with the index print sheets mounts, the result is bulky.

SUMMARY OF THE INVENTION

It is an object of the present invention to provide a photographic film and print organizer for storage of a film cartridge containing a film, prints and an index print sheet as an integral set.

It is another object of the present invention to provide a photographic film and print organizer which is easily assembled and compact.

It is another object of the present invention to provide a photographic film and print organizer which enables a film cartridge to be taken easily out of a cartridge holder.

These objects of the present invention are achieved by providing a photographic film and print organizer for carrying a rectangular index print sheet, on which miniature pictures are printed from all frames of a roll of exposed and developed negative film and arranged in order of progressive frame number, and holding a cylindrical film cartridge containing the roll of exposed and developed negative film. The film and print organizer is comprised of a rectangular index print sheet carrying means for carrying the rectangular index print sheet thereon and a cartridge holder for holding the film cartridge. The cartridge holder is formed as an integral part of the index print sheet carrying means. The rectangular index print sheet carrying means is provided a with retainer means for retaining the rectangular index print sheet on the index print sheet carrying means. The index print sheet carrying means may be in the form of a mount sheet made of a cardboard sheet or a plastic sheet, a hard book cover, an envelope or a foldable envelope.

The retainer means may also take the form of retainer slits formed at four corners of the mount sheet for receiving corners of the rectangular index print sheet, a transparent sheet secured to the mount sheet along three sides of the mount sheet to receive and retain the rectangular index print sheet placed between the mount sheet and the transparent sheet, or a transparent envelope for receiving the rectangular index print sheet therein which is itself retained at corners by retainer slits formed at four corners of the mount sheet.

The cartridge holder comprises a generally cylindrically looped extension formed as an integral part of the index print sheet carrying means to receive therein a cylindrical film cartridge. The cylindrically looped extension may be formed with an opening through which the cylindrical film cartridge is exposed to the outside. Further, the cylindrically looped extension is formed with retainer flaps at opposite open ends which can be folded downward for retaining the cylindrical film cartridge in the cartridge holder. The cartridge holder may comprise an elongated extension formed as an integral part of the rectangular mount sheet and looped and retained to a back of the rectangular mount sheet to form a cylindrical space for receiving therein a cylindrical film cartridge. In this instance, the elongated extension is formed with an opening through which the cylindrical film cartridge is exposed to the outside. The elongated extension may further be formed with retainer flaps at opposite open ends which can be folded downward for retaining and preventing the cylindrical film cartridge from slipping off. Otherwise, the cartridge holder may comprise a box formed as an integral part of the rectangular mount sheet.

The photographic film and print organizer of this invention may further include a re-order form made of a transparent sheet on which re-order numbers for extra prints are written, the re-order form being shaped and sized in conformity with the index print sheet and having the same number of ruled sections as the number of miniature pictures printed on the index print sheet. The re-order form is placed on the index print sheet and retained by the retainer means together with the index print sheet.

With the film and print organizer of the present invention, an integral set of a film cartridge containing a roll of exposed and developed film, prints made from frames of the exposed and developed film, and an index print sheet, on which miniature pictures are printed from all frames of the exposed and developed negative film and arranged in order of frame number, are all returned together to the customer and stored compactly. For re-ordering extra prints, it is easy to specify desired pictures and quantities thereof with reference to the index print sheet. In addition, the film and print organizer of the present invention reliably retains the film cartridge.

BRIEF DESCRIPTION OF THE DRAWINGS

The above and other objects and features of the present invention will be clearly understood from the following description of preferred embodiments thereof when considered in conjunction with the accompanying drawings, wherein the same reference numerals have been used to denote same or similar elements or parts throughout the drawings, and in which.

DETAILED DESCRIPTION OF THE PREFERRED EMBODIMENTS

Figure 1:
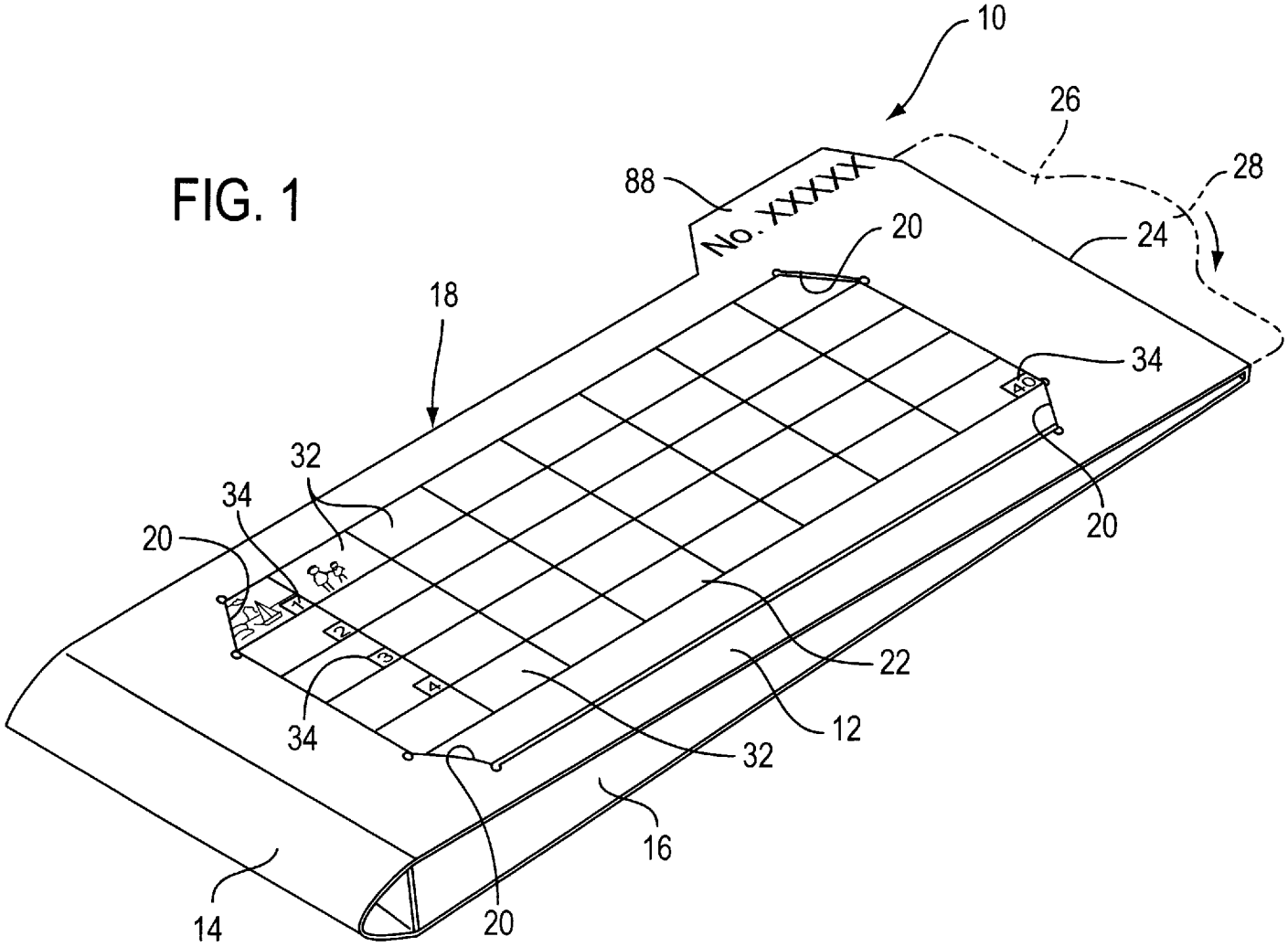
FIG. 1 is a perspective view of a book cover type of film and print organizer in accordance with an embodiment of the present invention.
Figure 2:
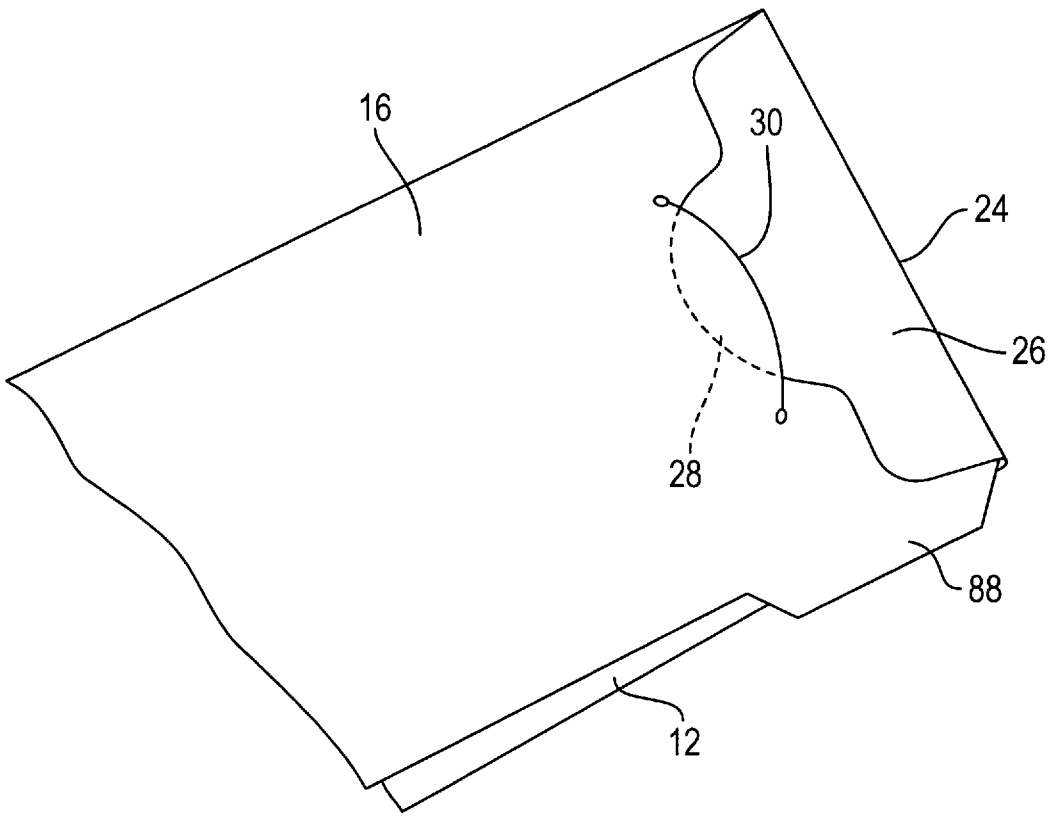
FIG. 2 is a perspective view of the film and print organizer of FIG. 1 as seen from the back.

Referring to the drawings in detail, and in particular, to FIGS. 1 to 4, there is shown a generally rectangular hard-cover book type photographic film and print organizer 10 for filing and storing an index print sheet which includes pictures, for instance, contact-printed from all frames of an exposed and developed negative film on a single sheet, and regular size and/or extra size of prints made from the negative film, and a film cartridge containing the negative film therein from which the index print was made.

As seen in FIG. 1, a rectangular index print sheet 22 includes miniature positive pictures 32 printed on a photographic paper sheet or a regular paper sheet from a roll of exposed and developed negative film. These miniature pictures 32, which may be color or black-and-white, are reduced in magnification to be smaller than a regular print size and may be smaller than the corresponding negative images. This index print sheet 22 can include, for instance, 40 pictures arranged in five lines, each line having eight pictures. On the index print sheet 22, the miniature pictures 32 are arranged vertically in order of the corresponding frame numbers of the negative film. Arabic numerals 34 printed at bottom corners of the respective miniature picture 32 correspond to the progressive frame numbers of the corresponding negative images.

The film and print organizer 10 has a rectangular hardcover receptacle or case 18 comprising three cover sections, namely a rectangular front cover 12, a spine or shelfback 14, and a rectangular back cover 16. This hardcover case 18 is preferably formed by folding a single sheet of cardboard or a plastic sheet in three and is sized in conformity with a panorama size, or the like, of prints. The front cover 12 has corner slits 20 at the four corners thereof. An index print sheet 22 is held on the outside front cover 12 with its four corners received in the corner slits 20 with the image side up (see FIG. 1). Otherwise, the index print sheet 22 may be held on the inside front cover 12 in the manner shown in FIG. 3. The hardcover case 18 is provided with a flap 26 folded inside along a fore-edge 24 as shown by a double dotted line in FIG. 1. A tab 28 of the flap 26 is inserted into a slit 30 formed in the back cover 16 to keep the hardcover case 18 closed.

Figure 3:
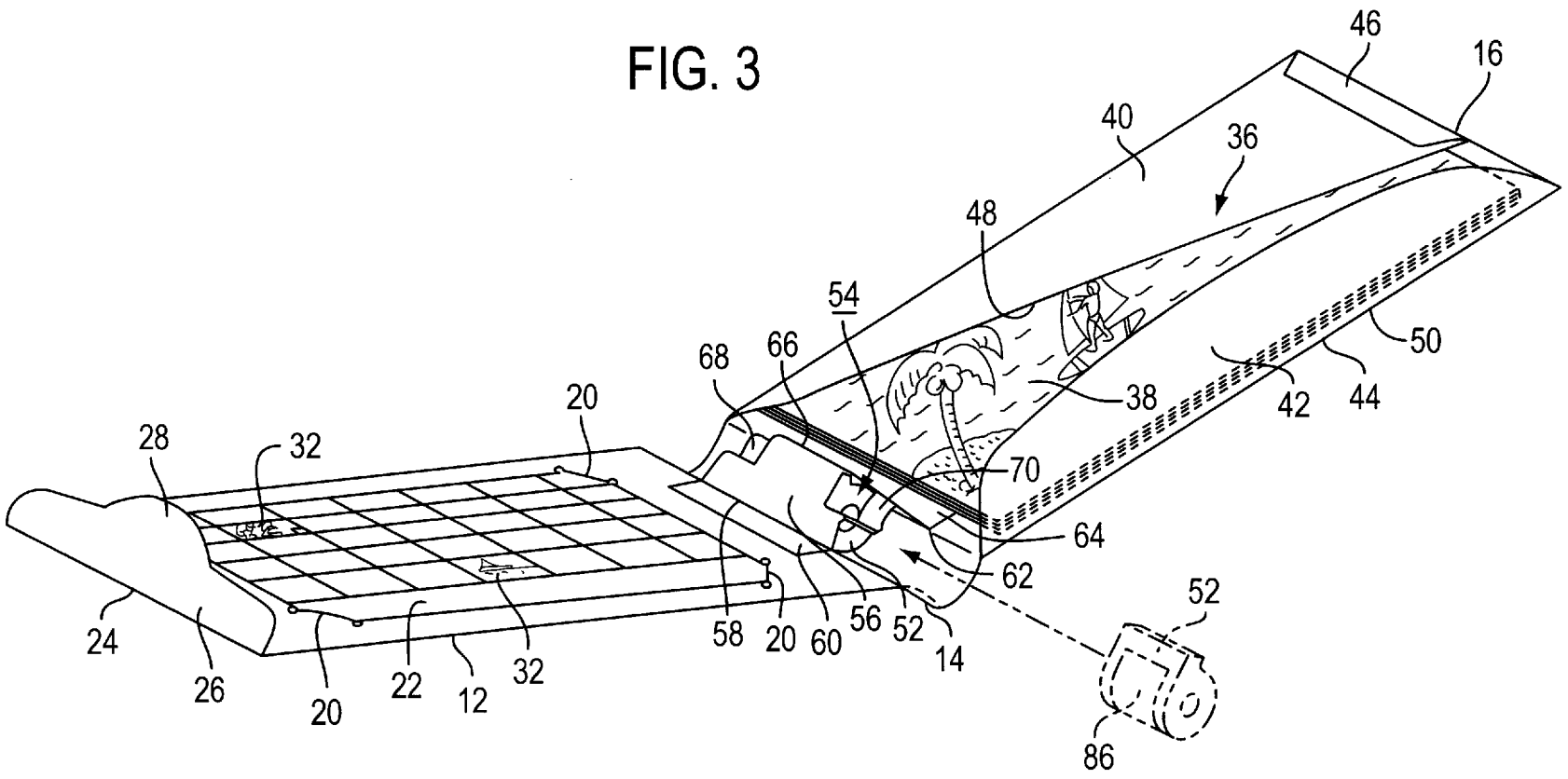
FIG. 3 is a perspective view of the unfolded film and print organizer of FIG. 1.

As shown in FIG. 3, the back cover 16 is formed on its inside cover with a print pocket 36 adapted to receive and hold therein at least a plurality of panorama size prints 38 in layers. The print pocket 36 comprises a generally triangular flap pocket 40 and a tuck flap 42. The pocket flap 40 is an integral part of the back cover 16 which is folded inside along a longitudinal upper edge 44. A fore-end flap 46 is folded inside and glued to the pocket flap 40. The tuck flap 42 is also an integral part of the back cover 16 which is folded inside along a longitudinal lower edge 44. The picture pocket 42 thus formed provides an entrance 48 for prints 38 at an end remote from the fore-end where the fore-end flap 46 is glued. Pictures in the picture pocket 36 are stopped from slipping out of the picture pocket 36 by the tuck flap 42.

The shelfback 14 is provided with a cartridge holder 54 for holding a film cartridge 52 on its inside stay facing. The cartridge holder 54 is formed by, for instance, a cardboard strip 56. The cardboard strip 56 has side tabs 60 and 64 which are folded along folding lines 58 and 62 and glued to the inside cover of the back cover 16. The cardboard strip 56 is folded along a folding line 66 extending along the overall length thereof to form a holding space 54 for a film cartridge 52 between the inside stay facing of the shelfback 14. The cardboard strip 56 has tabs 68 and 70 integrally formed therewith at its longitudinal edges, which are folded toward the inside stay facing of the shelfback 14 to abut a film cartridge 52 after insertion of the film cartridge 52 into the holding space 54. The film cartridge 52 put into the cartridge holder 54 is snugly held therein by the strip 56 and prevented from slipping out of the cartridge holder 54 by the end tabs 68 and 70.

Figure 4:
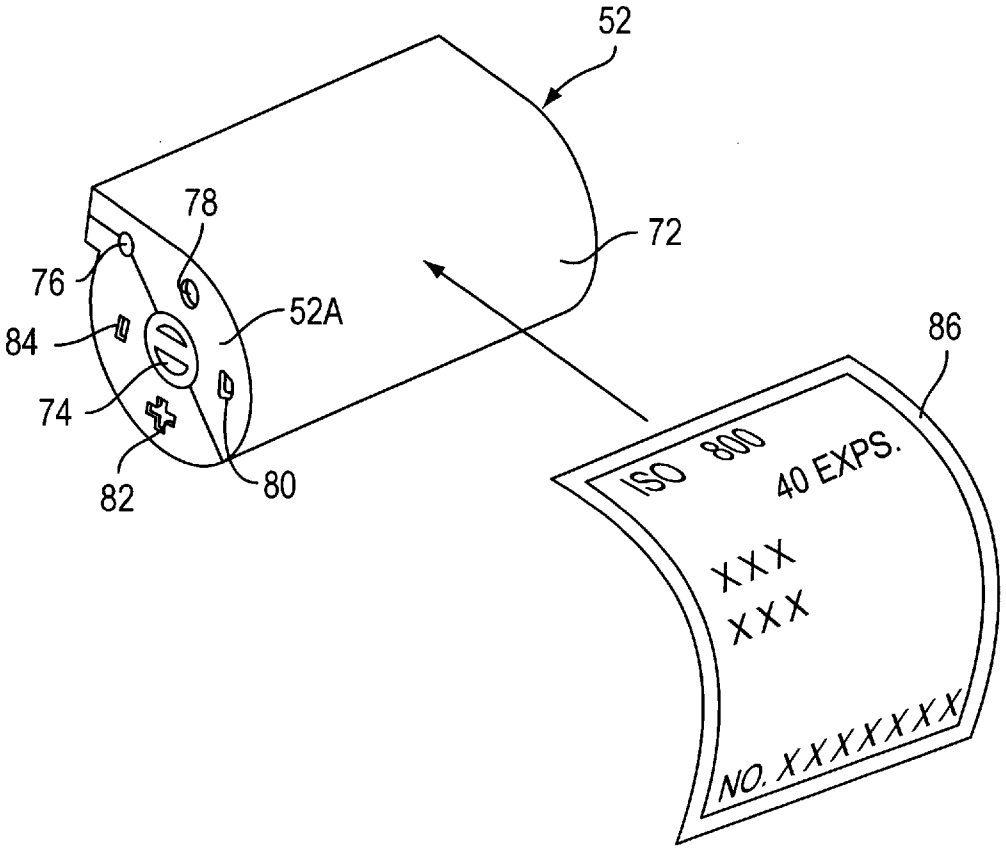
FIG. 4 is a perspective view of a film cartridge.

As shown in FIG. 4, the film cartridge 52 comprises a cartridge body 72, a spool 74 and a pivoting light shielding slat 76 (only a pivot of the slat is shown), all of which are made of plastic materials. The film cartridge 52 contains the entire length of an unexposed film strip rolled up on the spool 74. When the spool 74 is rotated, it forces the film strip out of the film cartridge 52 one frame for every exposure, or the film is pulled by a known camera mechanism. After exposure of all of the frames, the film is completely rolled back in the film cartridge 52.

The film cartridge 52 has a plurality of indices, for instance four indices in this embodiment, for visually indicating various current states of the film within the film cartridge 52. The cartridge body 52 has four index openings 78, 80, 82 and 84 formed in a side wall 52A. These index openings 78 are different in shape from one another and are arranged on a circle at regular angular intervals, i.e. 90°. One of these index openings 78, 80, 82 and 84 is closed by a sector blade (not shown) disposed within the cartridge body 72 according to the current state of the film cartridge 52.

For example, the index opening 78 is in the shape of a circle and, when it is closed by the sector blade, indicates that the film cartridge 52 contains a roll of unexposed or fresh film. The index opening 80, which is in the shape of a semi-circle, indicates that the film in the cartridge 52 has been exposed for some frames but still contains some unexposed frames when it is closed by the sector blade. The index opening 82, which is in the shape of a cross, indicates that the film in the cartridge 52 has been completely exposed when it is closed by the sector blade. The index opening 84, which is in the shape of a rectangle, indicates that the film in the cartridge 52 has been developed when it is closed by the sector blade. The index system thus structured can visually indicate to the user various current states of the film contained in the film cartridge 52 by the shape of the index opening that is closed by the sector blade.

A film cartridge 52 with the rectangular index opening 84 closed by the sector blade, i.e. containing a completely exposed film, is put in the photographic film and print organizer 10. Together, an index print sheet 22, which shows miniature pictures printed from the respective frames of the film in the cartridge 52, is attached to the inside or outside front cover 12, and regular prints, also printed from some or all frames of the film in the cartridge 52, are put in the picture pocket 36. The film cartridge 52 has a guide label 86 adhered to the cartridge body 72. The guide label 86 shows film information including a film speed range, the number of frames of the film, and cartridge identification number, for example.

As shown in FIG. 1, the front cover 12 is formed with an index spot 88 in a form of a tab for indicating the contents of the photographic film and print organizer 10 at a top right corner. An identification mark is printed on, or otherwise attached to, the index tab 88 to identify the photographic film and print organizer 10 and distinguish it from others.

At the photo-laboratory where film cartridges 52 with exposed films are forwarded from photoshops, the exposed films are withdrawn and developed. For each developed film, an index print sheet 22 is provided as well as regular and/or enlarged prints 38. After having necessary prints and an index print sheet made, the film is returned into the film cartridge 52. An integral set of film cartridge 52, index print sheet 22 and prints 38 is put in a photographic film and print organizer 10. As was described, the index print sheet 22 is disposed on the front cover 12. The photographic film and print organizer 10 with the integral set of film cartridge 52, index print sheet 22 and prints 38 is closed by inserting the tab 28 of the flap 26 into the slit 30 of the back cover 16 and then returned to the photoshop. The customer gets film and prints contained together as a set in the photographic film and print organizer 10. The photographic film and print organizers 10 are convenient for customers to store film and pictures. The index spot 88 of the photographic film and print organizer 10 may be used to print, for instance, an order number for matching with the customer's order stub.

Figure 5:
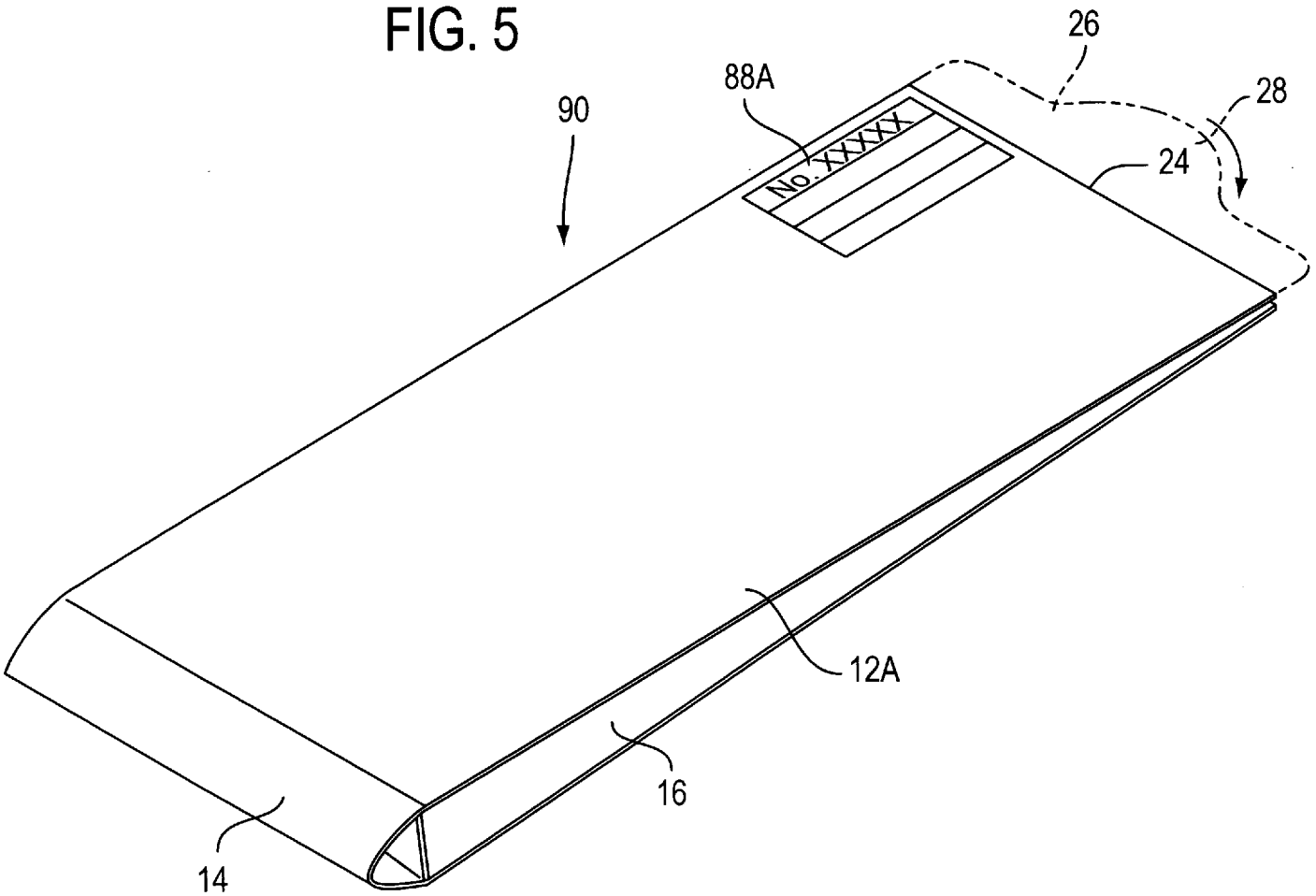
FIG. 5 is a perspective view of a book cover type of film and print organizer in accordance with another embodiment of the present invention.
Figure 6:
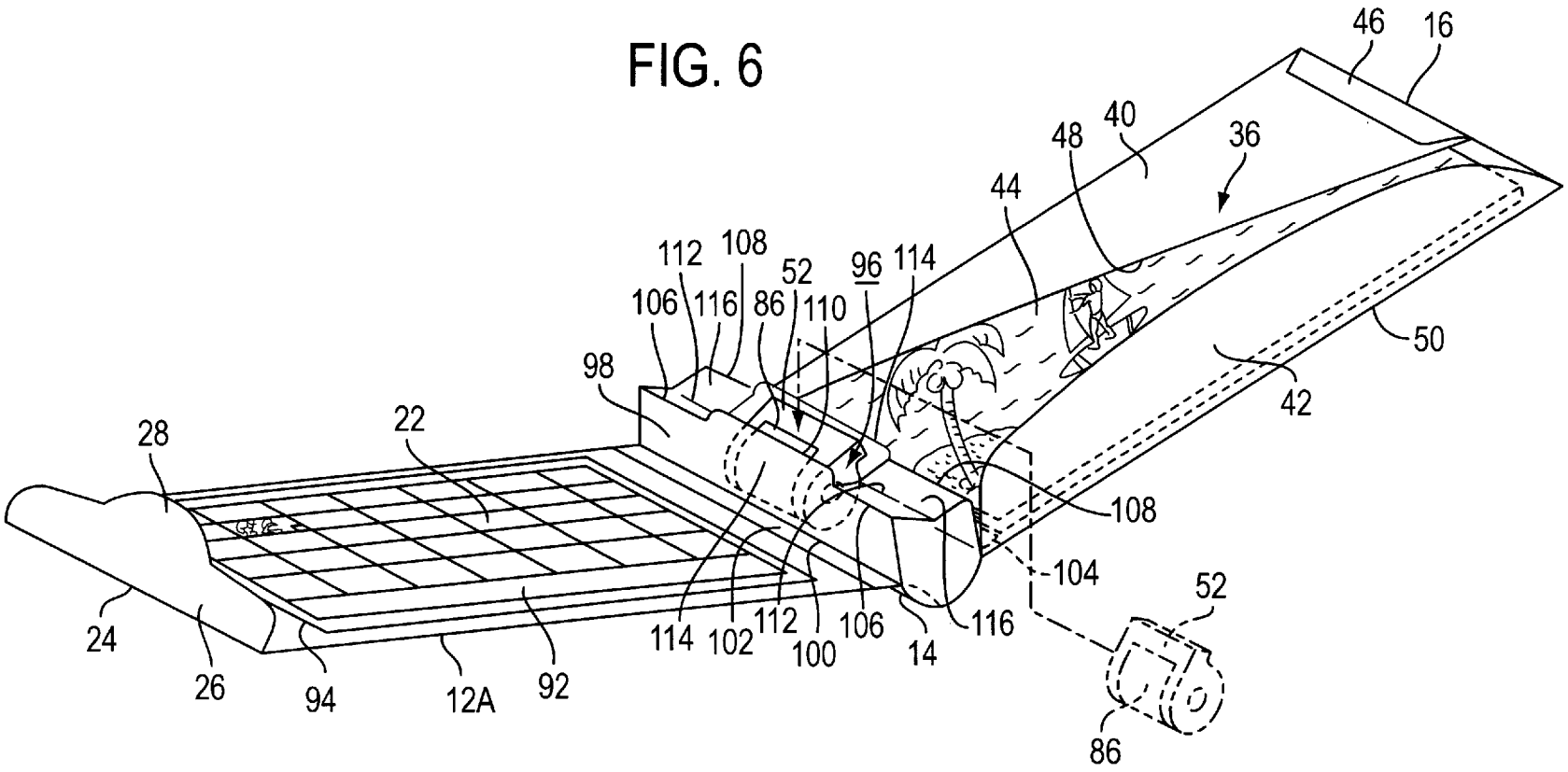
FIG. 6 is a perspective view of the unfolded film and print organizer of FIG. 5.

FIGS. 5 and 6 illustrate a photographic film and print organizer 90 in accordance another embodiment of the present invention. The photographic film and print organizer 90 has an index spot 88A printed on the front cover 12 at the upper right corner and a transparent sheet 92. The transparent sheet 92 is adhered to the inside front cover 12 along three sides. Between the transparent sheet 92 and the inside front cover 12 an index print sheet 22 is placed. At the remaining side of the front cover 12 an opening 94 is formed for insertion and removal of the index print sheet 22. The transparent sheet 92 prevents the index print sheet 22 from being scratched and/or getting dirty.

The photographic film and print organizer 90 has a cartridge holder 96 on the inside stay facing of the shelfback 14, which is made of a paper strip 98 that is as long as the shelfback 14. The strip 98 has a longitudinal lateral margins 102 and 104 folded outside along folding lines 100 (only one of which is shown), by means of which the strip 98 is adhered to the shelfback 14. Further, the strip 98 is folded inside along folding lines 106 and 108 to form an opening 110 for receiving a film cartridge 52 in a cavity between the folding lines 106 and 108. The opening 110 is reduced in width by squeezing the retainer tabs 116 downward along center lines 112 to be disabled from receiving a film cartridge 52. For entry of a film cartridge 52, pull tabs 114 at both sides of the opening are turned up to widen the opening 110 sufficiently for a film cartridge 52 to be put in the cartridge holder 96. A film cartridge 52 is dropped in the cartridge holder 96 while the pull tabs 114 are turned up. When the pull tabs 114 are released, the strip 98 restores its squeezed shape and reduces the width of opening 110, preventing the film cartridge 52 from slipping out from the cartridge holder 96. The upper and lower retainer tabs 116 retain the film cartridge 52 at their edges to prevent the film cartridge 52 from moving longitudinally in the opening 110.

Figure 7:
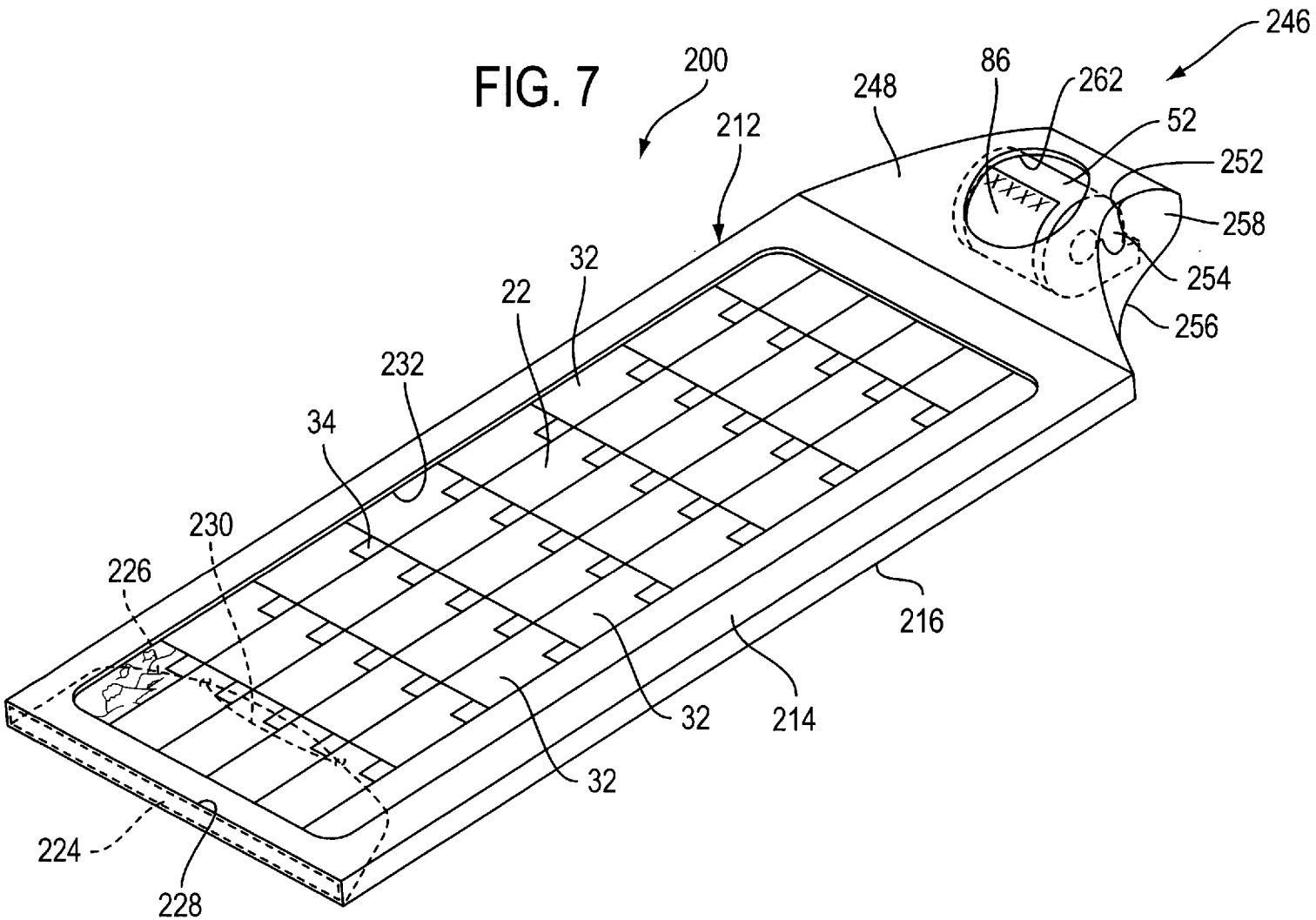
FIG. 7 is a perspective view of an envelope type of film and print organizer in accordance with another embodiment of the present invention.
Figure 8:
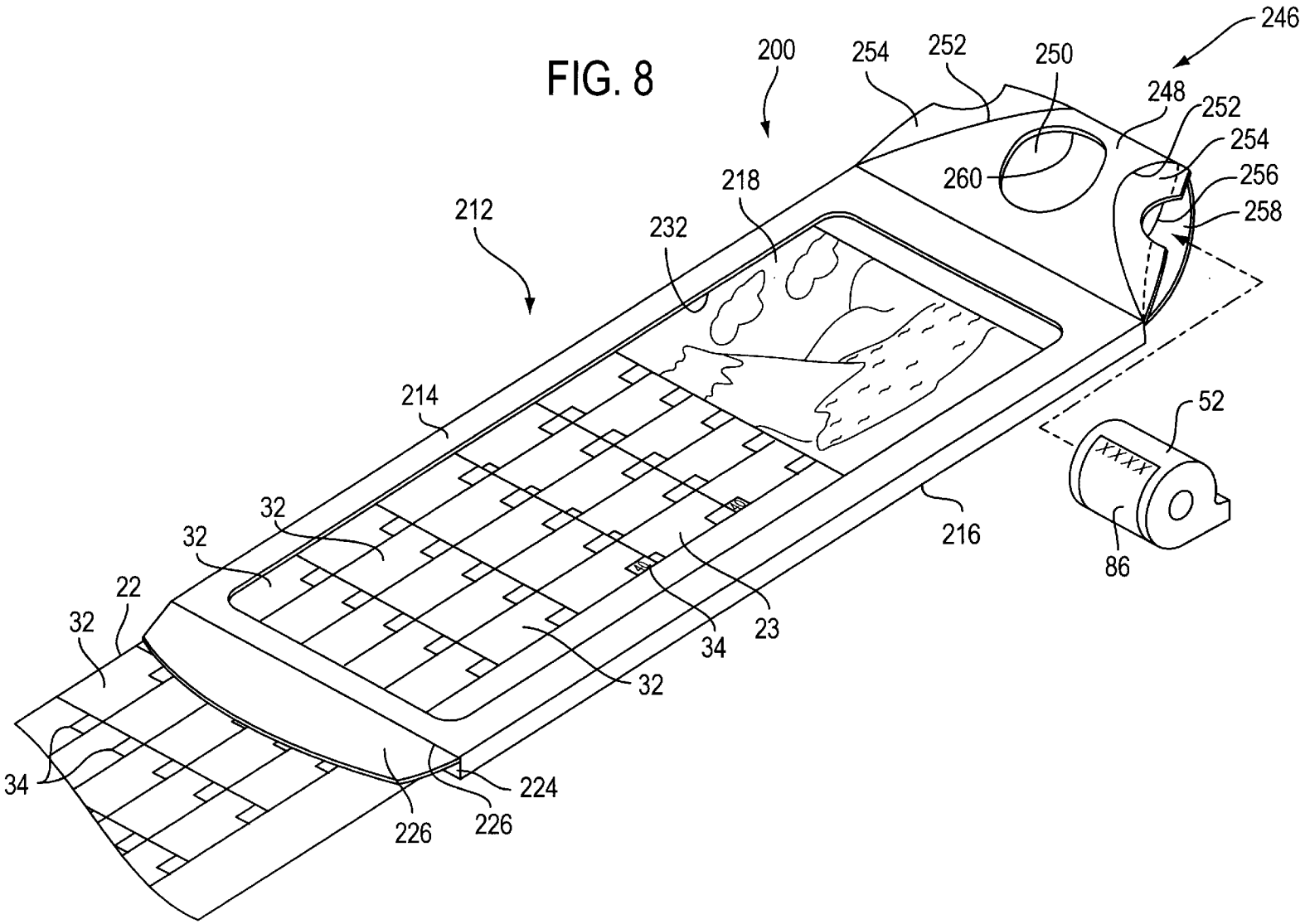
FIG. 8 is a perspective view of the film and print organizer with an index print sheet, prints, a re-order form and a cartridge.
Figure 9:
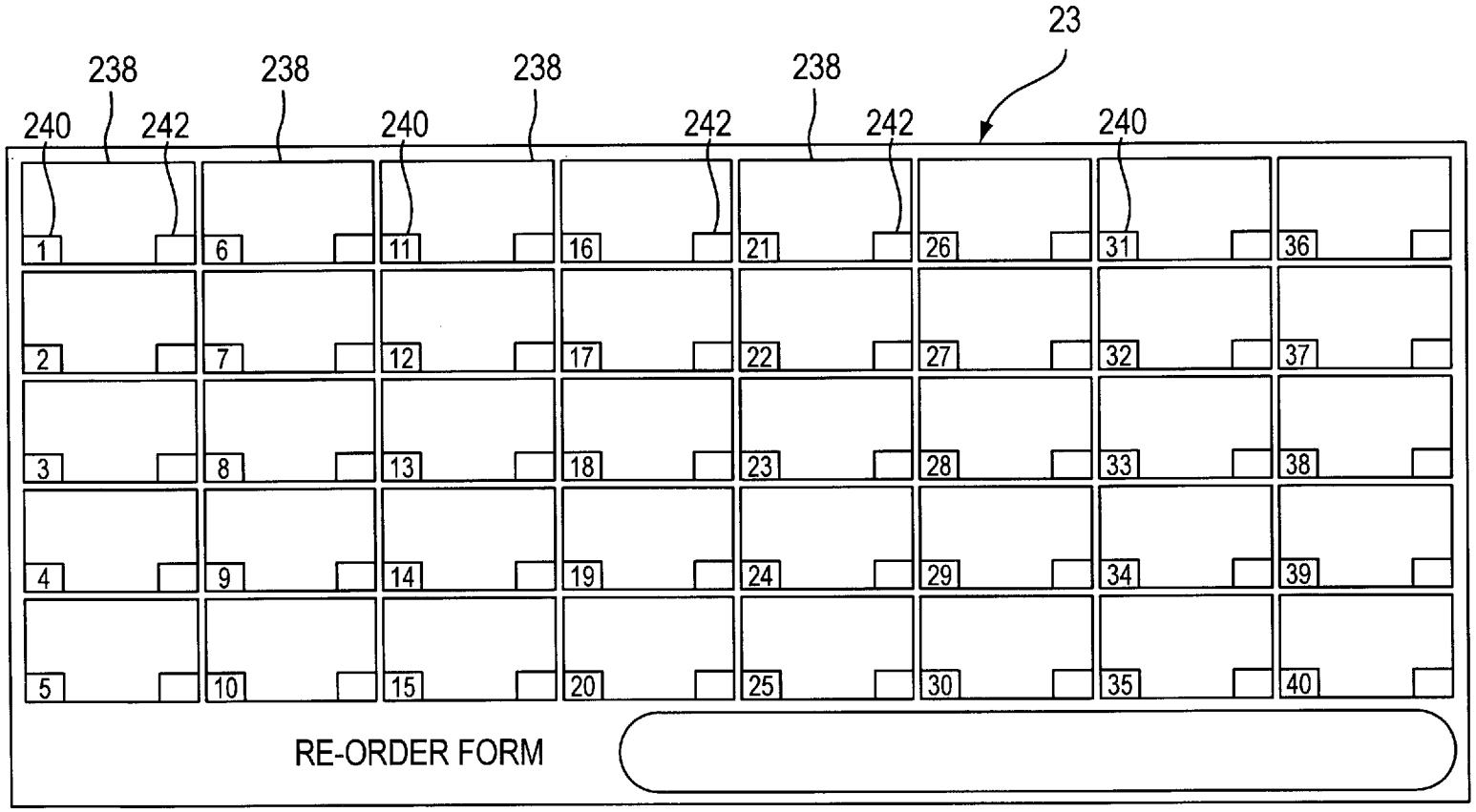
FIG. 9 is a plan view showing a re-order form.

FIGS. 7–9 show an envelope type of photographic film and print organizer 200 in accordance with another embodiment of the present invention. The photographic film and print organizer 200 is formed by folding a single sheet of paper or a single plastic sheet in an envelope fashion. The envelope-shaped rectangular receptacle 212 comprises a rectangular paper sheet front cover 214 and a rectangular paper sheet back cover 216 forming therebetween a space sufficient to receive and hold an index print sheet 22, a panorama size of prints 218 and a several pieces of re-order forms 23 in a stack. The index print sheet 22, prints 218 and re-order forms 23 are taken in and out the envelope-shaped receptacle 212 through an end opening 224 shown by a broken line in FIG. 7. The front cover 214 is formed integrally with a flap 226 folded along a folding line 228. The flap 226 is put into a slit 230 (shown by broken line) in the back cover 216, thus closing the opening 224 of the receptacle 212 to prevent the contents from slipping out of the receptacle 212. The receptacle 212 is formed with a see-through window 232 in the front cover 214 to expose miniature pictures 32 of the index print sheet 22 on the top of the stack in the receptacle 212. The see-through window 232 is desirably covered by a transparent sheet.

As shown in FIG. 9, the re-order form 23, which is made of a ruled transparent sheet, has a size in conformity with the index print sheet 22. The re-order form 23 has the same number of, for instance forty in this embodiment, sections 238 as the miniature pictures 32 printed on the index print sheet 22. The sections 238 are arranged and numbered in the same order as the miniature picture 32. Each of sections is sized in conformity with a miniature picture 32 and has a frame number 240 printed thereon and a sub-section 242 through which a frame number 34 printed on the index print sheet 22 for each miniature picture 36 is viewed. The re-order form 23 is placed over the index print sheet 22 to allow the customer to mark the number of extra prints for each picture 32, while viewing the miniature pictures 32 and frame numbers on the index print sheet 22 through the re-order form 23. If it is necessary to make extra prints, the photographic film and print organizer 200 is brought to a photoshop after entry of the numbers of extra prints on the re-order form 23 for the respective pictures by the customer.

The receptacle 212 is provided with a cartridge holder 246 at one end, remote from the end where the opening 224 is provided, which is formed as an integral extension 248 of the front cover 214 by gluing a free end to the back cover 216 to form a space 250. The cartridge holder 246 is cylindrical and has at top and bottom ends thereof, retainer tabs 254 and 258 foldable inside along circular arc folding lines 252 and 256, respectively. When these retainer tabs 254 and 258 are pushed and folded inside after putting a film cartridge 52 in the holding space 250, they close top and bottom openings of the holder space 250 to prevent the film cartridge 52 from slipping out of the cartridge holder 246. The cartridge holder 246 is formed with a see-through window 260 through which the guide label 86 of the film cartridge 52 held by the cartridge holder 246 is seen. The film cartridge 52 is easily pushed longitudinally out from the cartridge holder 246.

The photographic film and print organizers 200 are convenient for customers, in particular, to re-order extra prints, as well as to store film and pictures. This envelope type of photographic film and print organizer 200 is easily assembled can be produced in high quantities at low costs, as compared with the hardcover type of photographic film and print organizer 10.

Figure 10:
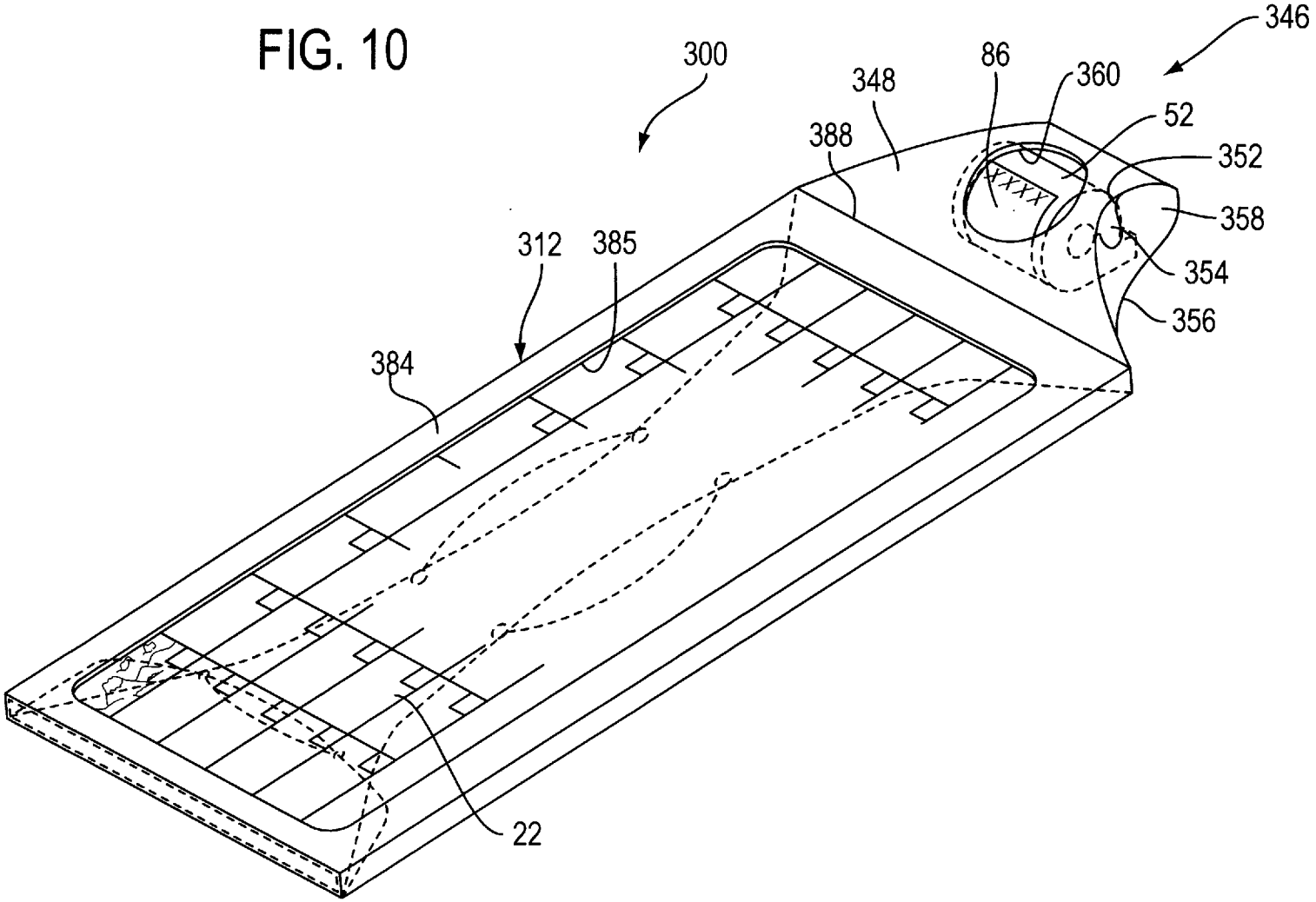
FIG. 10 is a perspective view of an envelope type of film and print organizer in accordance with another embodiment of the present invention.
Figure 11:
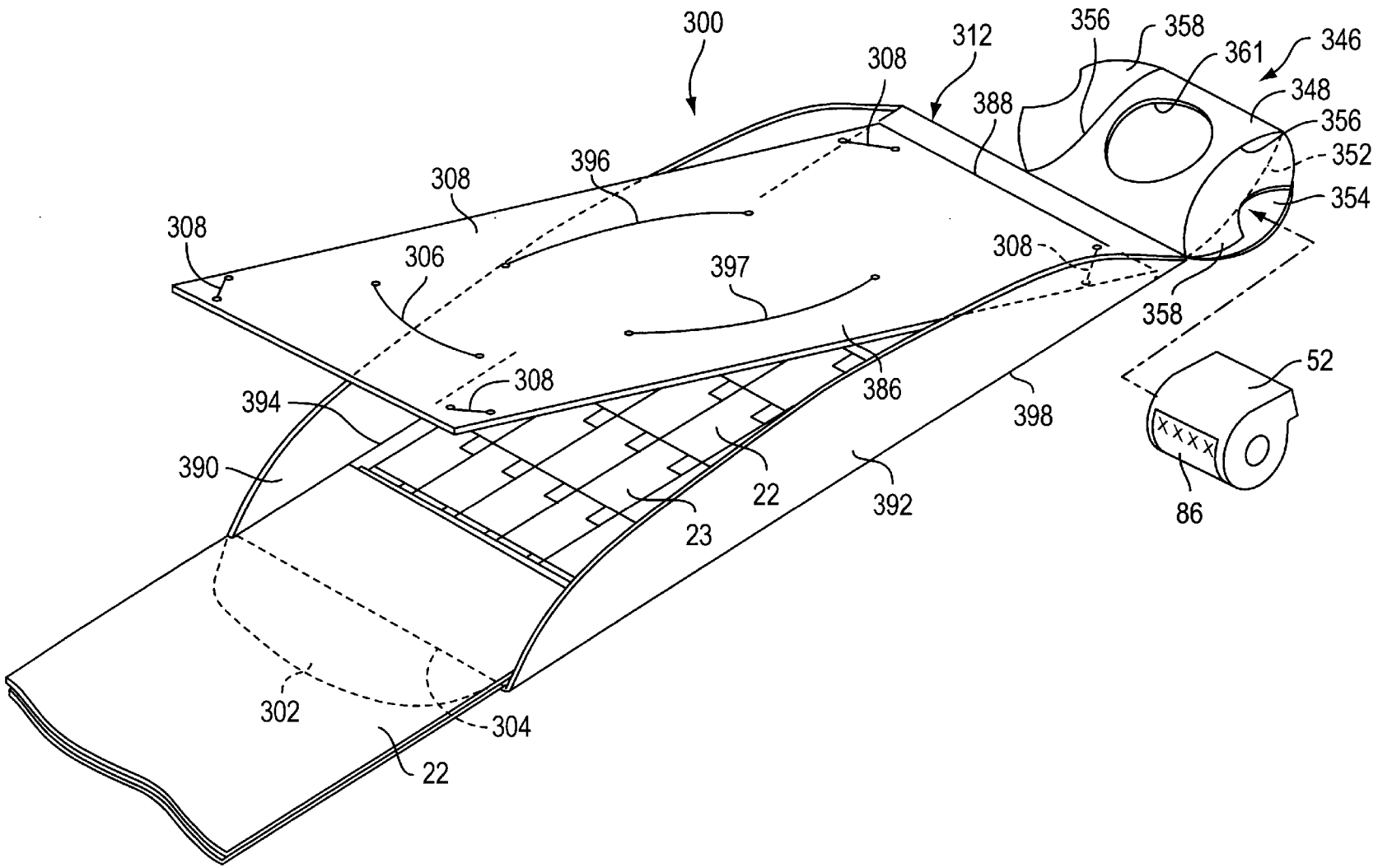
FIG. 11 is a perspective view of the film and print organizer of FIG. 10 as seen from the back which is unfolded.
Figure 12:
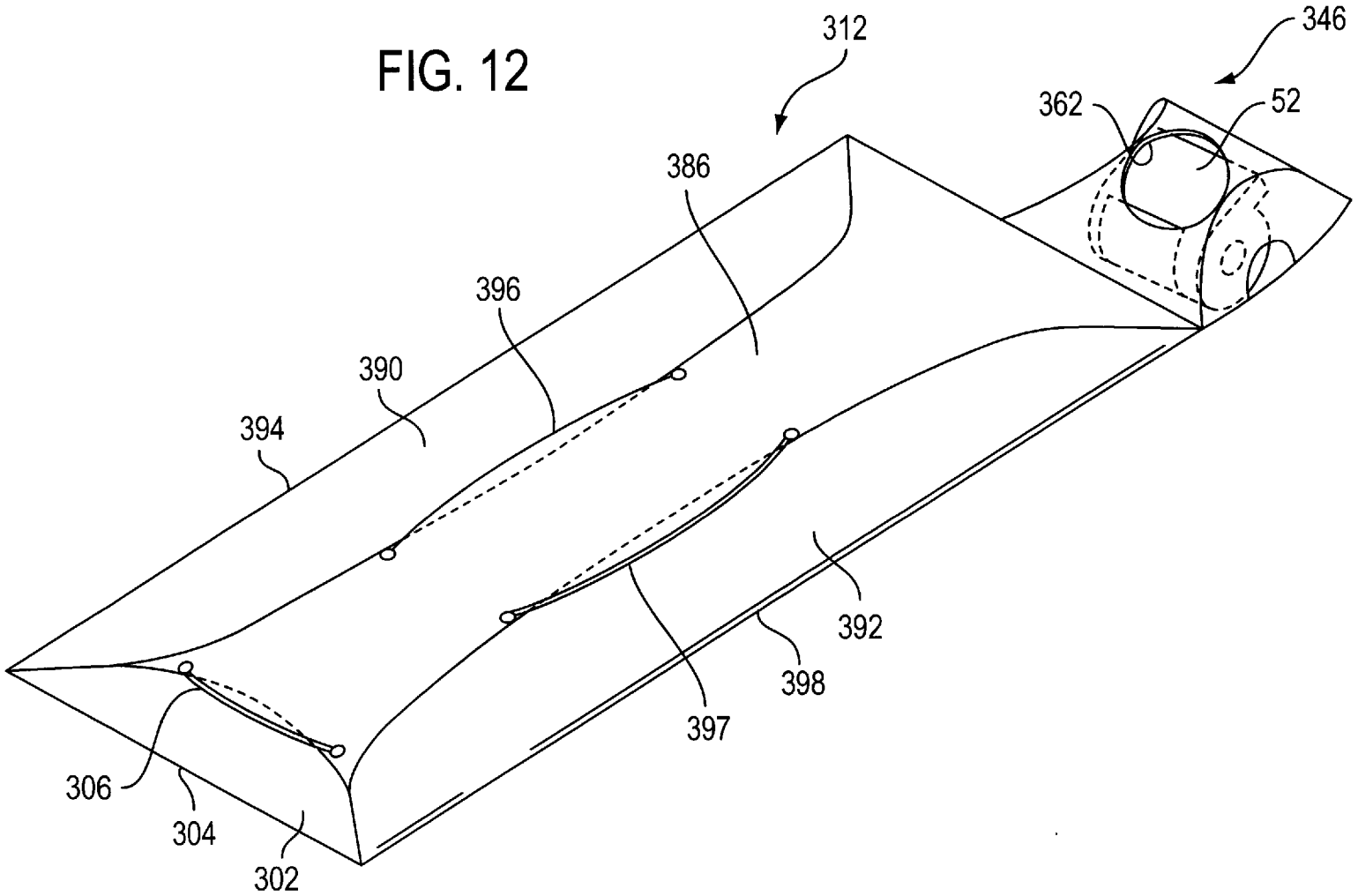
FIG. 12 is a perspective view of the film and print organizer of FIG. 10 as seen from the back which is folded.

FIGS. 10–12 show a photographic film and print organizer 300 in accordance with another embodiment of the present invention. While the photographic film and print organizer 300 is of an envelope type, it is capable of opening and closing. The photographic film and print organizer 300 is formed by folding a single paper sheet or a plastic sheet in an envelope fashion. Specifically, the photographic film and print organizer 300 comprises a generally rectangularly-shaped receptacle 312 made by doubling a single sheet of paper or a single plastic sheet along a folding line 388 to form rectangular paper sheet front and back covers 384 and 386. The receptacle 312 has a see-through window 385, for an index print sheet 22, in the front cover 384. The back cover 386 is unfolded to open the receptacle 312 to put a stack of an index print sheet 22, prints 38 and at least a single sheet of re-order form 23 in the receptacle 312.

The front cover 384 is integrally formed with lateral flaps 390 and 392 folded toward the back cover 386 along upper and lower folding lines 394 and 398 respectively. These flaps 390 and 392 are folded backward to overlap the back cover 386 and are inserted into slits 396 and 397 formed in the back cover 386. The front cover 384 is further formed integrally with a flap 302 folded along a folding line 304. The flap 302 is put into a slit 306 in the back cover 386, thus closing one end of the receptacle 312.

A cartridge holder 346, which is formed in substantially the same shape and manner as in the previous embodiment, is formed with circular see-through windows 360 and 362 at front and back sides thereof. These see-through windows 360 and 362 enable the guide label 86 of the film cartridge 52 to be exposed even if the film cartridge 52 is put upside down in the cartridge holder 346. As shown in FIG. 11, the back cover 386 is formed with corner slits 308 at four corners for holding a re-order form 23 similar to the re-order form shown in FIG. 9 but not necessarily transparent. Although the re-order form 23 is, in this embodiment, attached to show frame numbers of requested extra prints to a photoshop, it may be placed on the back cover 386 during storage.

Figure 13:
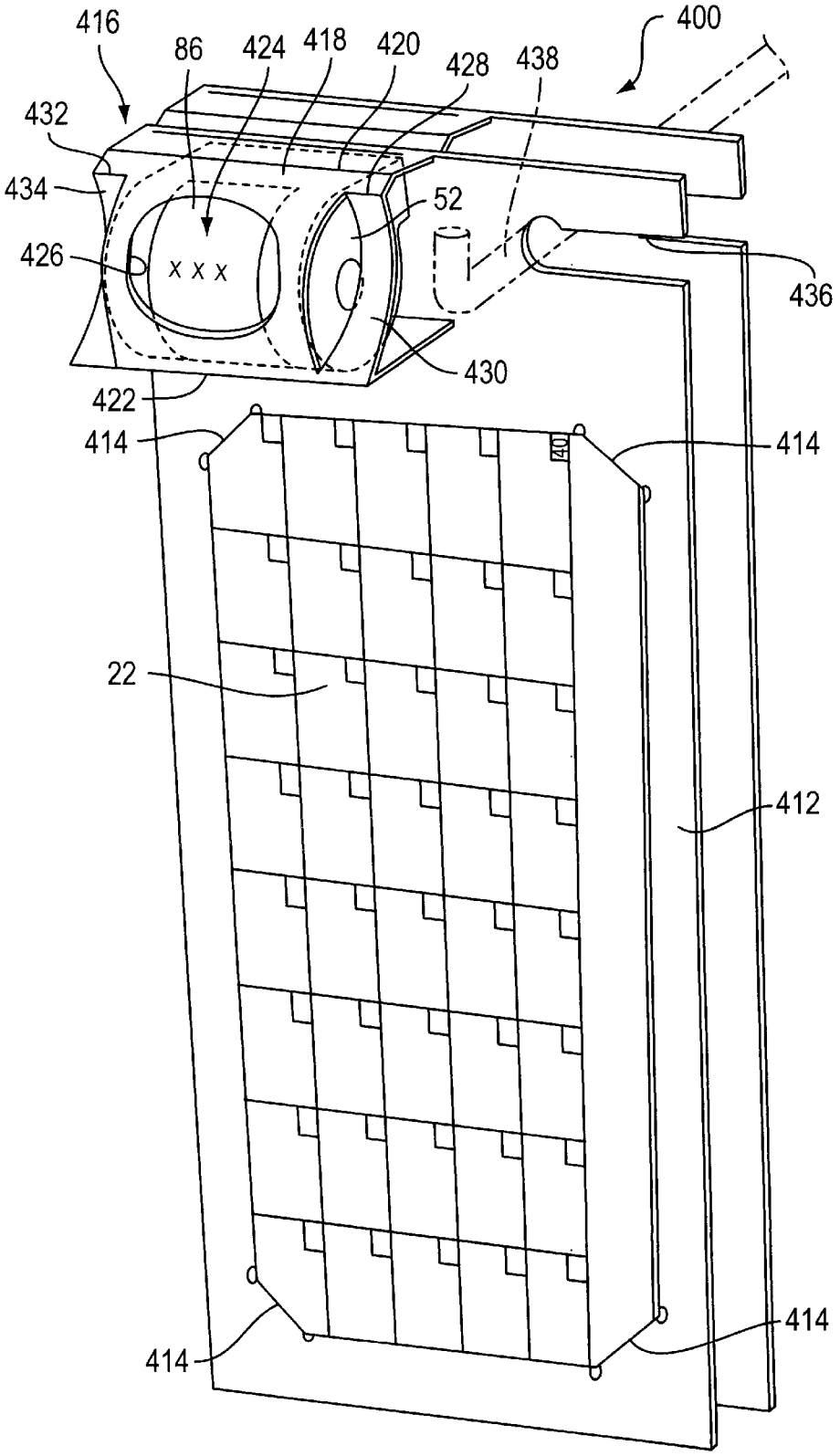
FIG. 13 is a perspective view of a hang-on type of film and print organizer in accordance with another embodiment of the present invention.

FIG. 13 shows a photographic film and print organizer 400 of a hang-on type having a blister or cardboard mount 412 for mounting a film cartridge 52 and an index print sheet 22, without regular prints, thereon.

A rectangular index print sheet mount 412 is formed with four corner slits 414 at four corners for holding an index print sheet 22 at four corners. The index print sheet mount 412 is provided with a cartridge holder 416 made of a separate rectangular paper strip 418 and secured thereto at an upper corner. The rectangular paper strip 418 is folded along folding lines 420 and 422 to form a generally cylindrically-shaped holder space 424 between the index print sheet mount 412 and the paper strip 418. The cartridge holder 416 has a see-through window 426 formed in the strip 418 for showing the guide label 86 of a film cartridge 52 held by the cartridge holder 416. Further, the strip 418 is formed with slits on both sides of the see-through window 426 so that outer sections can be turned down along side folding lines 422, 428 and 432 as a cartridge retainer device. These retainers 430 and 434 close top and bottom openings of the cartridge holder 416 to prevent the film cartridge 52 from slipping out of the cartridge holder 416.

The index print sheet mount 412 is formed with a hang-mount slot 436 extending perpendicularly from one side thereof and transversely to a half way point in the widthwise direction of an upper portion thereof. The index print sheet mount 412 is hung from a hanger bar 438 by way of the hang-mount slot 436 for storage or display.

Although, in the above embodiments, the cartridge holder 54, 96, 246, 346 or 416 is formed integrally with the receptacle, it may be prepared separately from a receptacle such as, in particular, the envelope type receptacles and the hang-on type cardboard mount and clipped on the receptacle.

Figure 14:
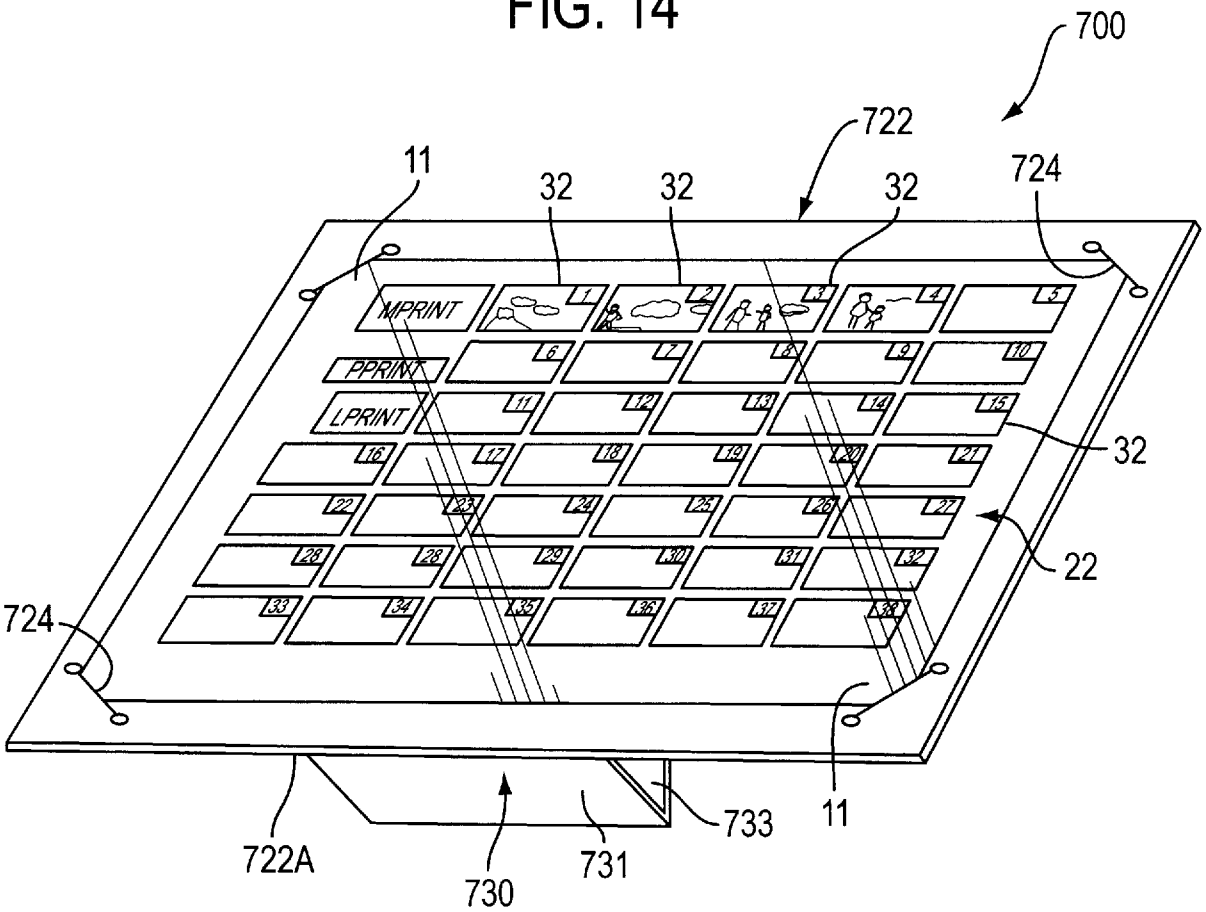
FIG. 14 is a perspective view of a mount sheet type of film and print organizer in accordance with another embodiment of the present invention.
Figure 15:
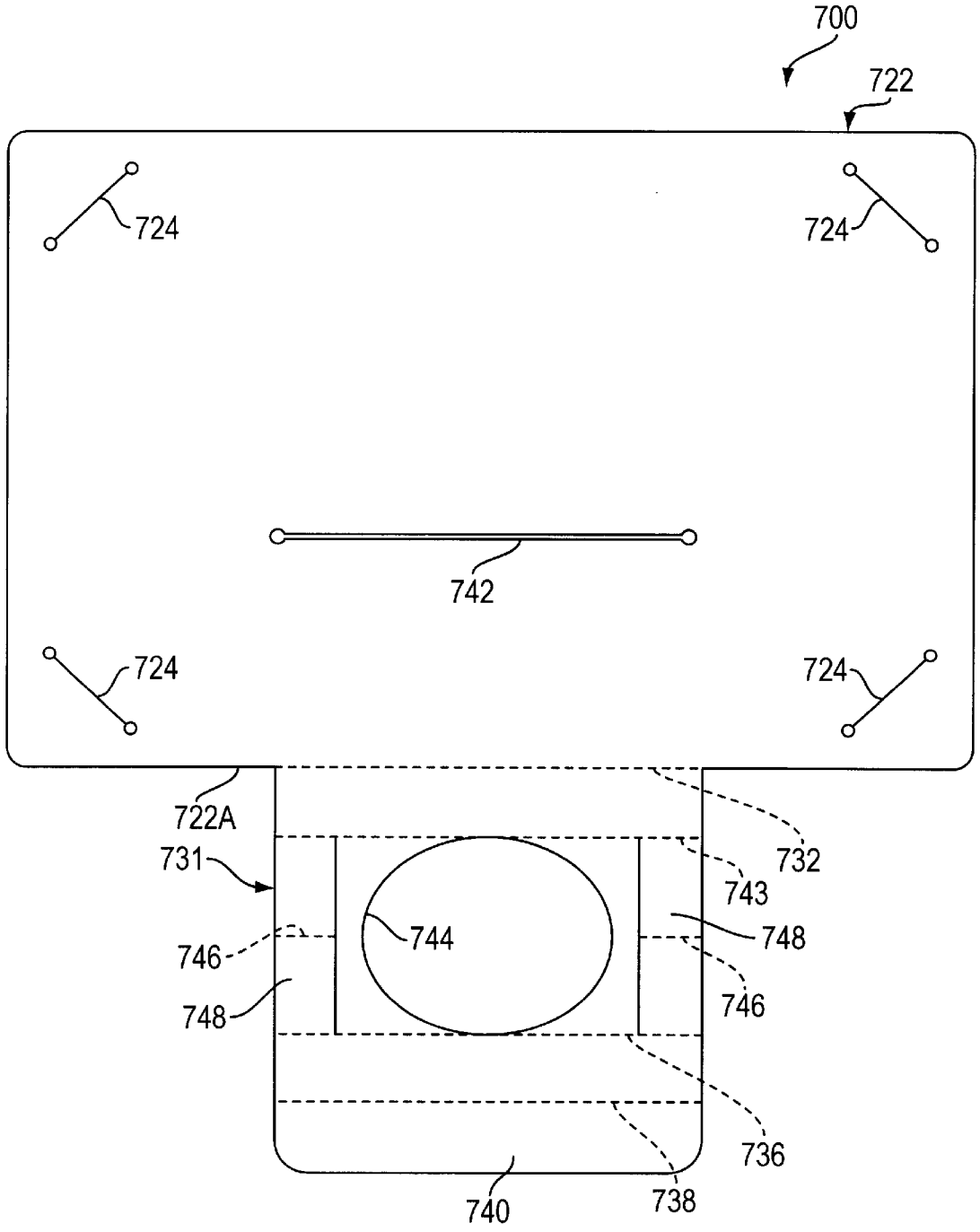
FIG. 15 is a developed view of the film and print organizer of FIG. 14.
Figure 16:
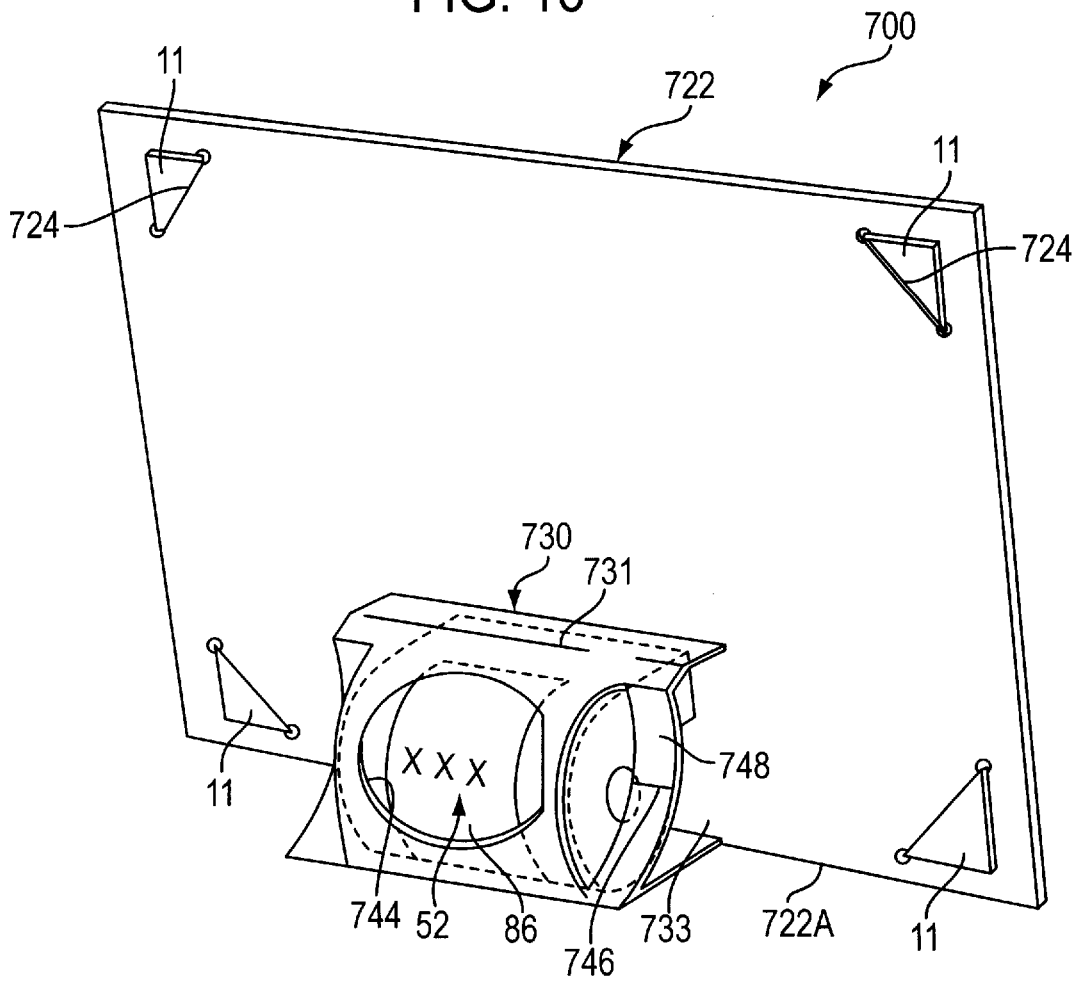
FIG. 16 is a perspective view of the film and print organizer of FIG. 14 as seen from the back.
Figure 26:
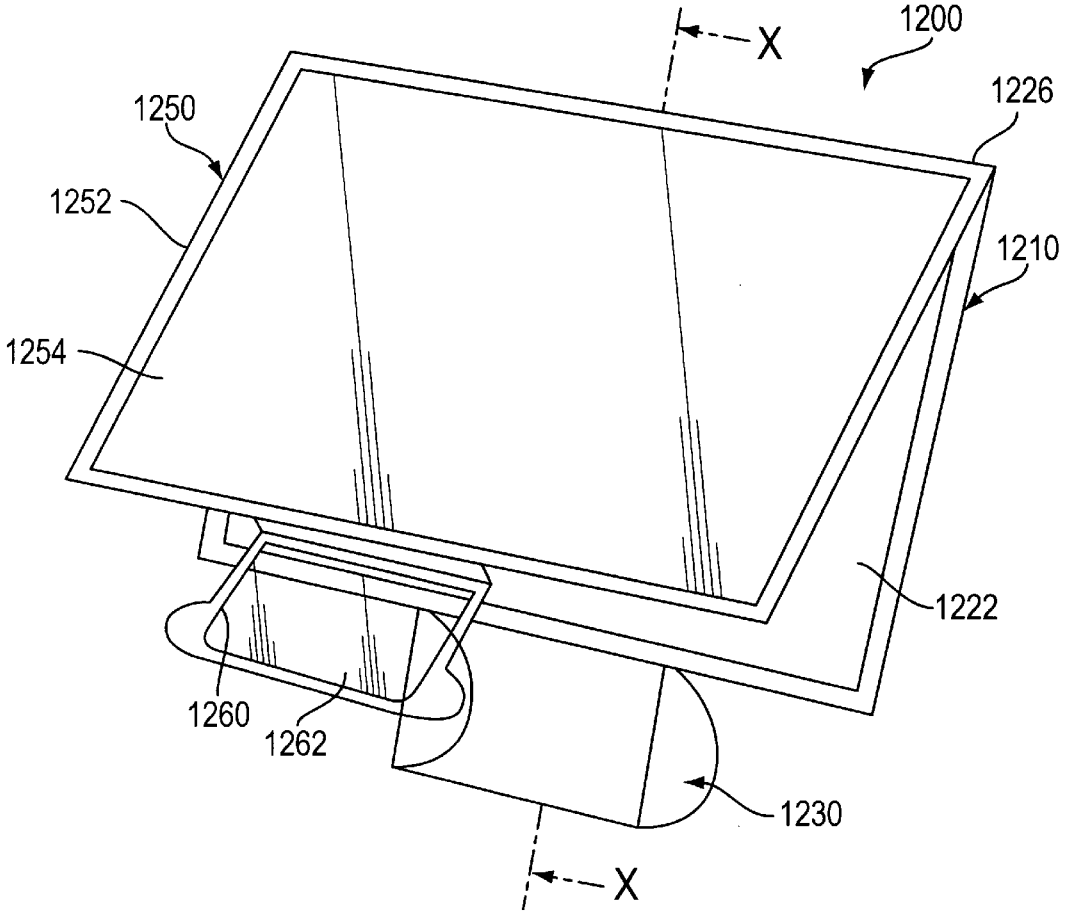
FIG. 26 is a perspective view of a mount sheet type of film and print organizer in accordance with another embodiment of the present invention.

Referring to FIGS. 14–16, an improved photographic film and print organizer 700 is shown, which comprises an index print sheet mount 722 on which an index print sheet 22 is attached and a film cartridge holder 730 for holding a film cartridge 52 therein. The index print sheet mount 722 is made of, for instance, a cardboard sheet of sufficient thickness and has corner slits 724 formed at its four corners. An index print sheet 22 is placed on the index print sheet mount 722 with its four corners 11 inserted in the corner slits 724. The index print sheet mount 722 is provided with a cartridge holder 730 secured to the back thereof. As is shown in detail in FIG. 15, the cartridge holder 730 is formed by folding a tab 731. The tab 731 is integrally formed as an integral part of the index print sheet mount 722 to extend along a lower edge 722A of the mount sheet. The integral tab 731 is folded along four folding lines 732, 734 and 736 as shown in FIG. 26. A flap portion 740 defined by the folding line 738 is inserted into a slit 742 in the index print sheet mount 722 and folded up along the folding line 738. In this manner, between the index print sheet mount 722 and the folded tab 731 a holding space is formed in the cartridge holder 730, in which a film cartridge 52, such as shown in FIG. 4, is received.

The cartridge holder 730 is formed with an elliptical opening as a see-through window 744. On both sides of the see-through window 744 the cartridge holder 730 is further formed with retainer flaps 748 foldable along center folding lines 746. By pushing and folding down the retainer flaps 748 after inserting a film cartridge 52 into the film holder 730, the retainer flaps 748 retain the film cartridge 52 to prevent film cartridge 52 from slipping out of the cartridge holder 730. The film cartridge 52 is easily removed through an end opening 733 after pushing up at least one of the retainer flaps 748.

Figure 17:
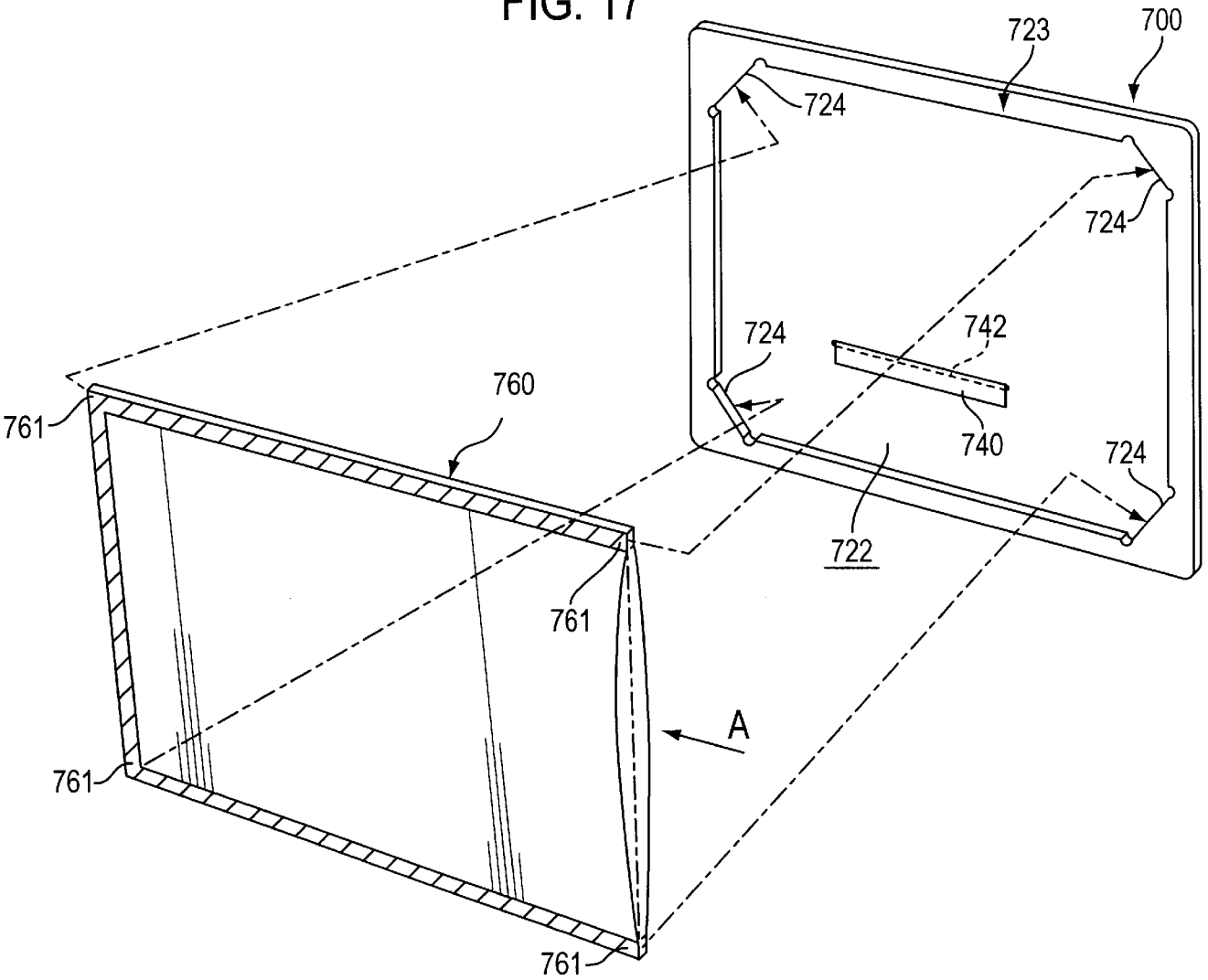
FIG. 17 is an exploded perspective view of a mount sheet type of film and print organizer in accordance with another embodiment of the present invention.

As shown in FIG. 17 illustrating a variant of the front of the photographic film and print organizer 700, the index print sheet mount 722 is formed with a peripheral frame 723 and corner slits 724. The transparent envelope 760, into which an index print sheet (not shown) is inserted in a direction indicated by an arrow A, is placed within the frame 723 on the index print sheet mount 722 with its four corners 761 inserted into the corner slits 724. The frame 723 has a thickness substantially equal to the thickness of the transparent envelope 760 with an index print sheet contained therein. The transparent envelope 760 is held on the index print sheet mount 722 with its surface flush with the surface of the peripheral frame 723 and protects the index print sheet from being scratched. The improved photographic film and print organizer 700 can orderly store a film cartridge 52 and an index print sheet 22 and enables the film cartridge 52 to be easily put therein and removed therefrom. Other portions of this variation are similar to FIG. 16.

Figure 18:
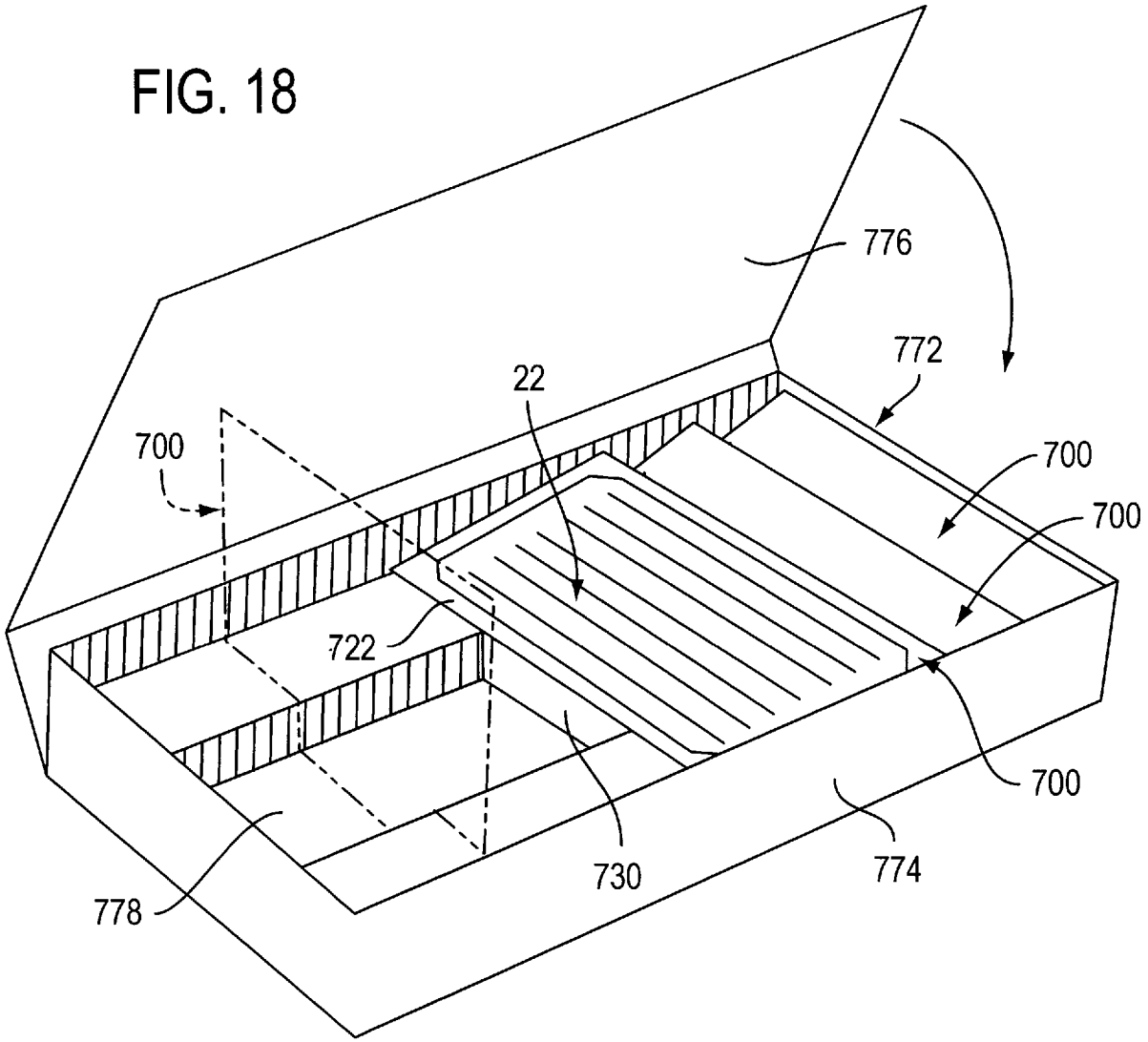
FIG. 18 is an illustration showing a number of the mount sheet type film and print organizers in a storage case.

As shown in FIG. 18, the photographic film and print organizers 700 shown in FIGS. 14–17 are stored in a box-shaped storage case 772 comprising a box 774 and a lid 776. The box 774 is formed with an elongated groove 778 having a width and depth that corresponds to the cartridge holder 730 on the back of the index print sheet mount 722. The index print sheet mount 722 is placed correct side up with the cartridge holder 730 positioned within the groove and overlapped an adjacent index print sheet mount 722. The index print sheet mount 722 can be stood up (i.e., turned like a page) making utilization of the cartridge holder 730 as a stay as shown by the broken line in FIG. 18. This makes it handy to locate a desired photographic film and print organizer 700 by viewing pictures of the index print sheet 22.

Figure 19:
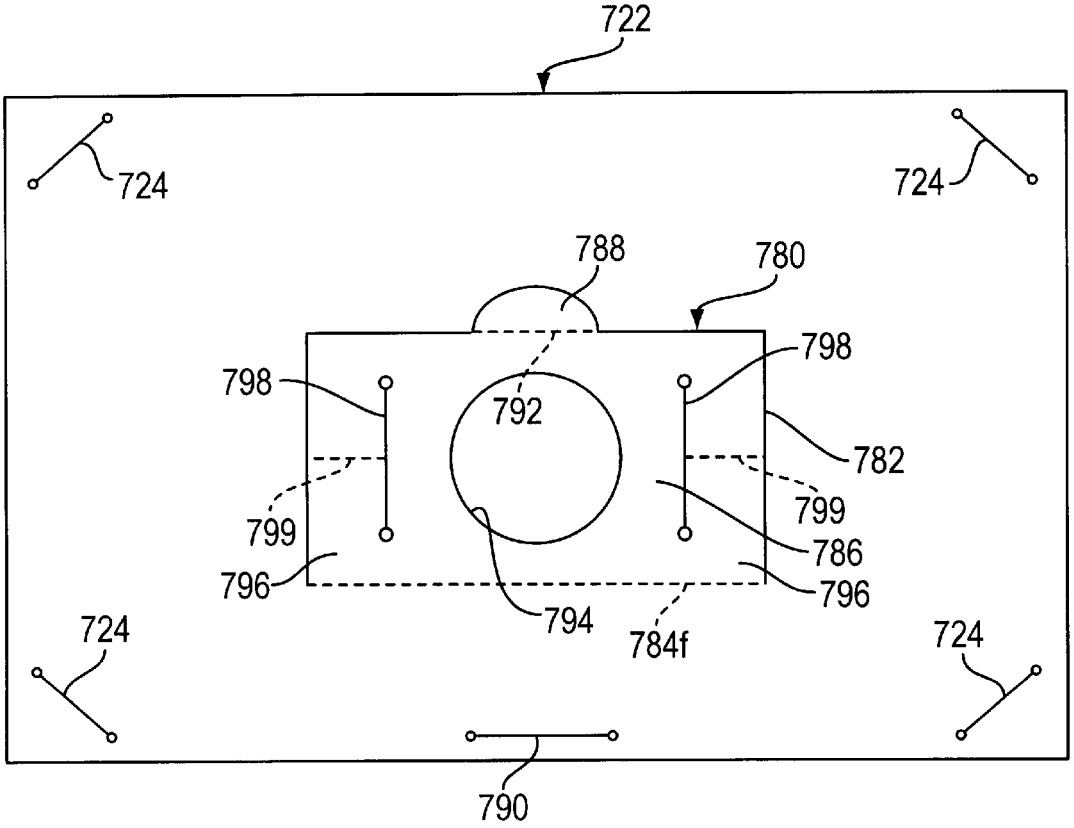
FIG. 19 is a front view of a mount sheet type of film and print organizer in accordance with another embodiment of the present invention.
Figure 20:
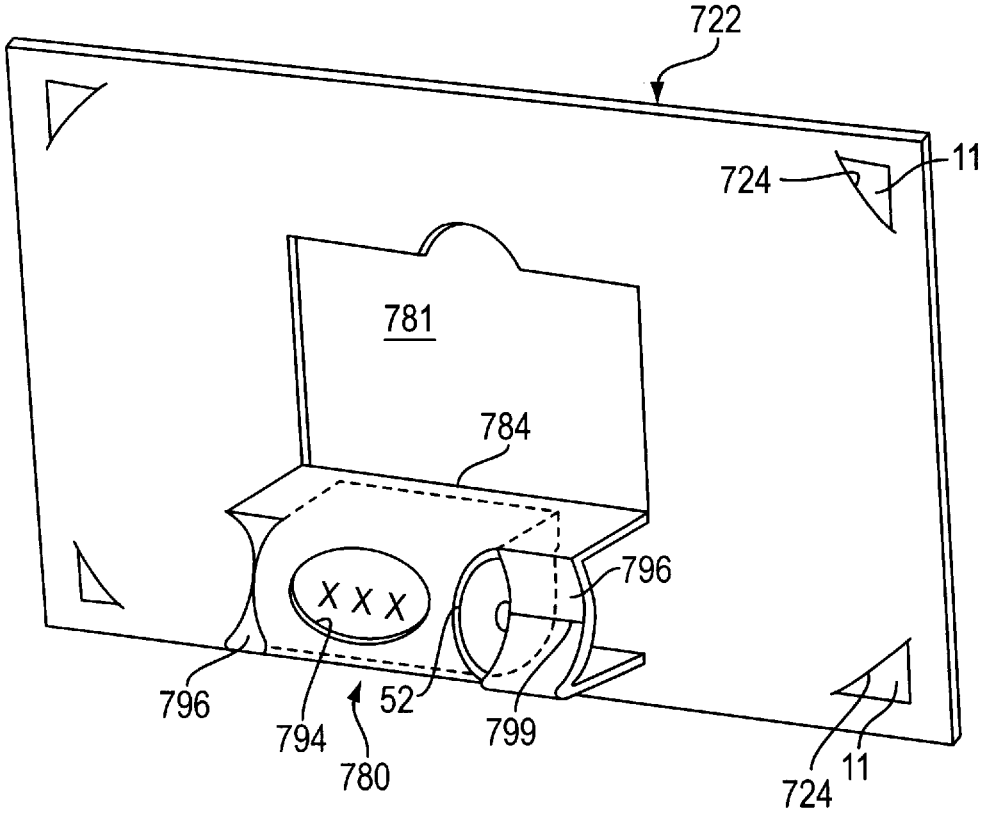
FIG. 20 is a perspective view of a mount sheet type of film and print organizer of FIG. 19 as seen from the back.

FIGS. 19 and 20 show another variant of the photographic film and print organizer 700 which has an improved cartridge holder 780. An index print sheet mount 722 is formed with a cut line 782 and a folding line 784 for defining a generally rectangular cartridge holder flap 786. At the top edge of the cartridge holder flap 786 there is provided a tuck tab 788 foldable along a folding lone 792. Further, the cartridge holder flap 786 is formed with a center opening 794 and slits or cut lines 798 on both sides of the center hole 794. The cut line 798 provides for the cartridge holder 780 side retainers 796. Between each side edge of the cartridge holder flap 786 and the already cut lines 798 the cartridge holder flap 786 is formed with a folding line 799. The index print sheet mount 722 is further formed with a slit 790 in close proximity to the lower edge.

After being pushed and folded downward along the folding line 284, the cartridge holder flap 786 is curled and the retainer tab 788 is inserted into the slit 790 to form an approximately cylindrical space for receiving a film cartridge 52 as shown in FIG. 20. The cartridge holder 780 thus provided holds the film cartridge 52 therein and retains it by side retainers 796 folded down along the folding line 799. The center opening 794 serves as a see through window for the guide label 86 of the film cartridge 52. A rectangular opening 781 left in the index print sheet mount 722 after having pushed out the cartridge holder flap 786 is covered up by an index print sheet attached to the index print sheet mount 722. The index print sheet mount 722 formed with the cartridge holder flap 786 is simply a shaped sheet. This reduces costs and saves space for storage before use.

Figure 21:
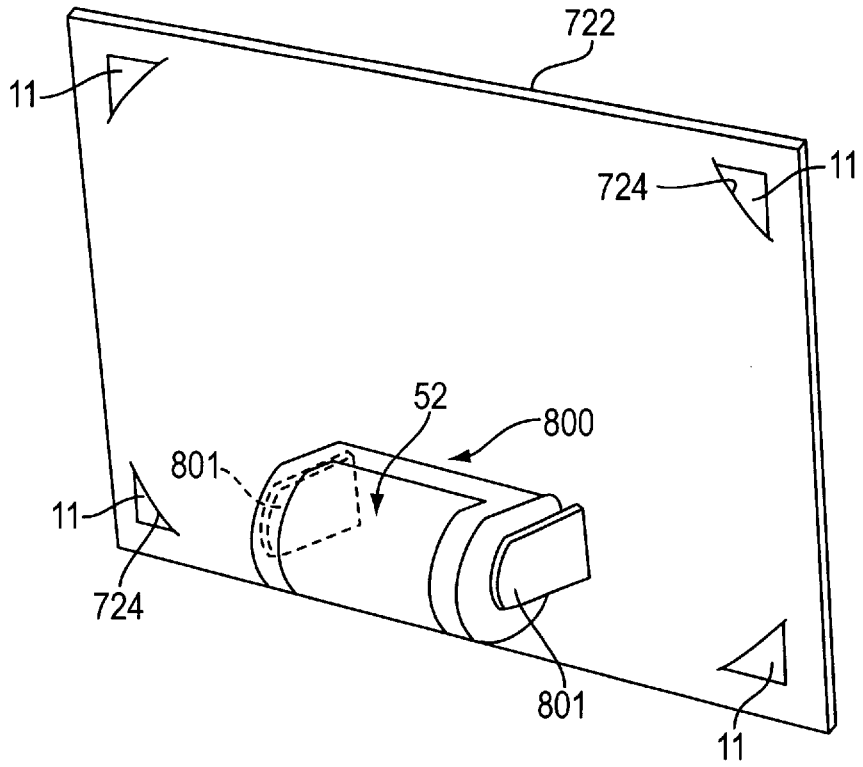
FIG. 21 is a perspective view of a mount sheet type of film and print organizer in accordance with another embodiment of the present invention as viewed from the back.
Figure 22:
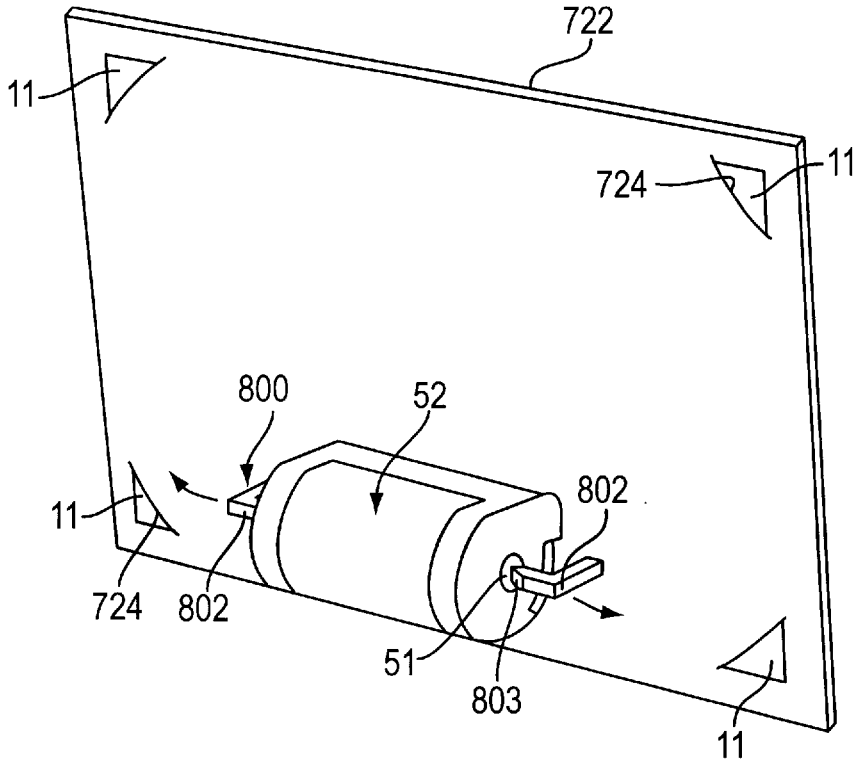
FIG. 22 is a perspective view of a mount sheet type of film and print organizer in accordance with another embodiment of the present invention as viewed from the back.

FIGS. 21 and 22 show variants of the cartridge holder 800 comprising holding arms. As shown in FIG. 21, the index print sheet mount 722 is provided with a pair of holding arms 801 separated at a distance slightly shorted than the length of a film cartridge 52. These holding arms 801, which are made of an elastic member such as plastics and synthetic rubbers, are deformed or bent by a film cartridge 52 and tend to restore to their original form to hold the film cartridge 52. With the cartridge holder 800, attaching or detaching the film cartridge 52 is accomplished by a single and simple action.

These holding arms may be formed to engage with both ends of a spool of the film cartridge. As shown in FIG. 22, the index print sheet mount 722 is provided with a pair of L-shaped holding arms 802 separated at a distance slightly shorter than the length of a spool of a film cartridge 52. These holding arms 802 are made of an elastic material, such as plastic or synthetic rubber. When the film cartridge 52 is put between the holding arms 802, the holding arms 802 are elastically deformed or bent by the film cartridge 52. Arm ends 803 are brought into engagement with end recesses 51, allowing the holding arms 802 to restore to their original form. In this manner, the holding arms 802 hold the film cartridge 52. With the cartridge holder 800, the film cartridge 52 is reliably held and retained without slipping off from the cartridge holder 800.

Figure 23:
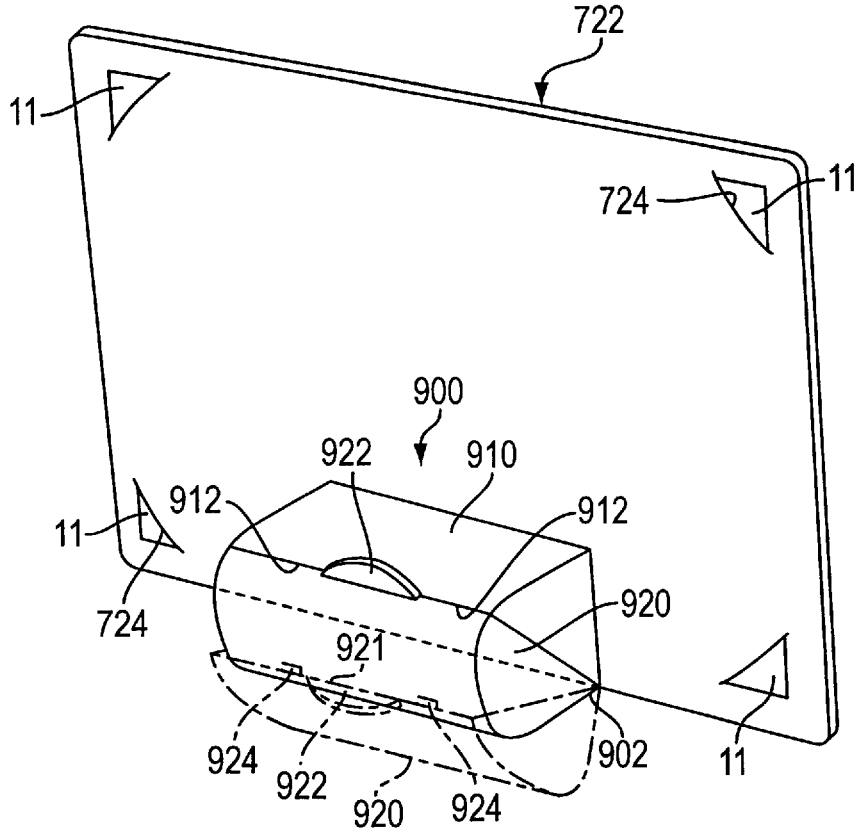
FIG. 23 is a perspective view of a mount sheet type of film and print organizer in accordance with another embodiment of the present invention as viewed from the back.

FIG. 23 shows a box type of cartridge holder 900 comprising an upper box 910 and a lower box 920. The upper box 910 is secured to the index print sheet mount 722. On the other hand, the lower box 920 is hinged to the lower edge 902 of the index print sheet mount 722 to pivot between an open position shown by a broken line and a closed position shown by a solid line. The lower box 920 is formed with a tab 922 and retainer tongues 924 arranged along the top edge 921 of the lower box 920. After placing a film cartridge (not shown) in the lower box 920, the tab 922 is picked up by the user. By pivoting the lower box 920 to the upper box 910, the retainer tongues 924 are brought into engagement with the upper margin 912 of the upper box 910 and hold the upper and lower boxes 910 and 920 closed due to frictional force therebetween.

Figure 24:
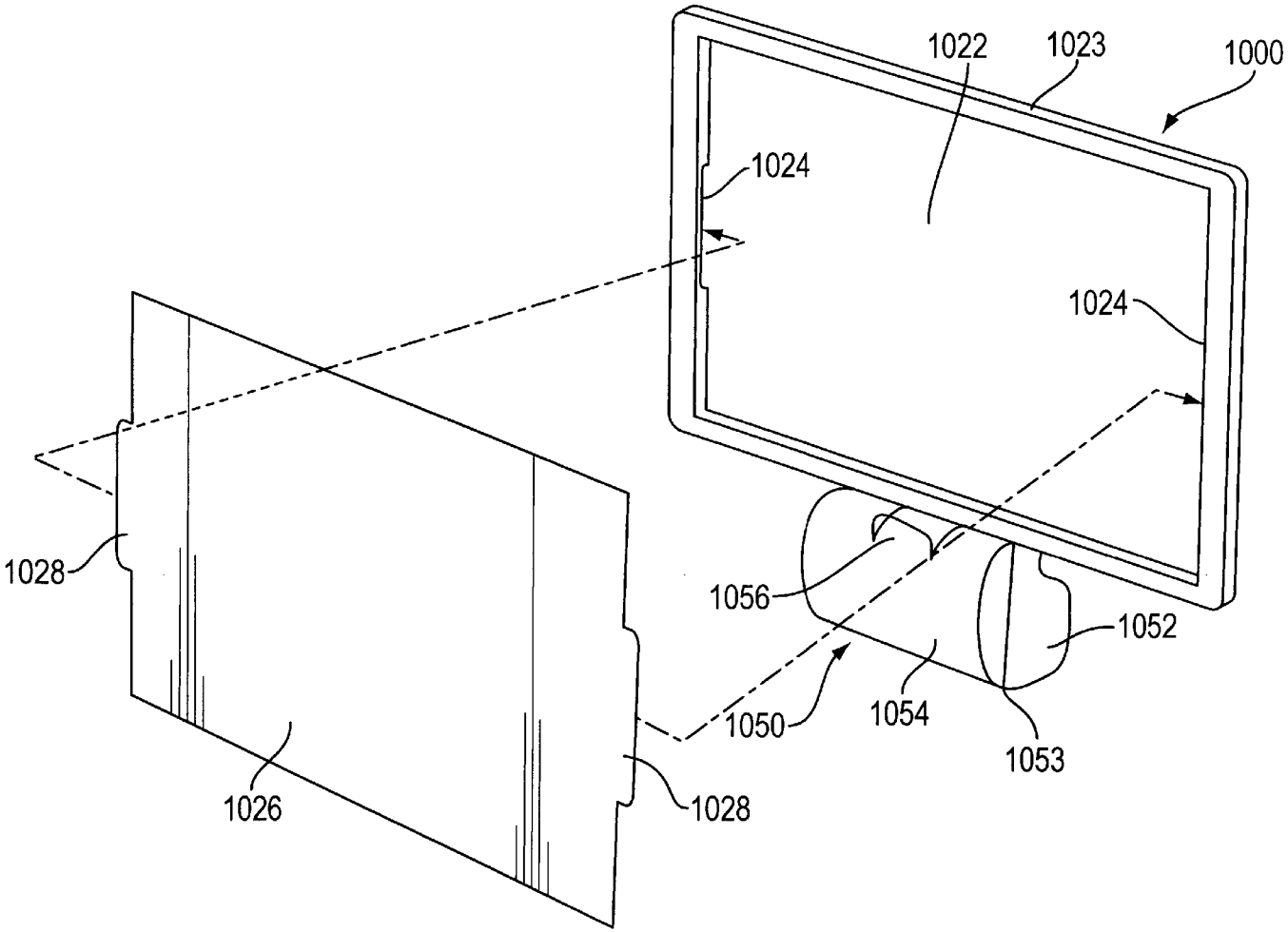
FIG. 24 is a perspective view of a mount sheet type of film and print organizer in accordance with another embodiment of the present invention as viewed from the back.

FIG. 24 shows a photographic film and print organizer 1000 according to another embodiment of the present invention. The photographic film and print organizer 1000 comprises an index print sheet mount 1022 and a cartridge holder 1050. The index print sheet mount 1022 is formed with a peripheral frame 1023 and side slots 1024. A transparent cover sheet 1026 having side tongues 1028 is placed within the frame 1023 on the index print sheet mount 1022 with the side tongues 1028 inserted into the side slots 1024. Between the index print sheet mount 1022 and transparent cover sheet 1026 an index print sheet (not shown) is placed.

The index print sheet mount 1022 is provided with a box type cartridge holder 1050 along the bottom edge. The cartridge holder 1050 comprises a holder box 1052 in which a film cartridge (not shown) is received and a lid 1054 with a pick-up tab 1056. The holder box 1052 is secured to the index print sheet mount 1022. The lid 1054 is hinged to the holder box 1052 along the lower edge 1053 to open and close the holder box 1052. The lid 1054 is turned downward by pulling manually the pick-up tab 1056 to open the holder box 1052 for placing a film cartridge in the holder box 1052 and turned upward by pushing the pick-up tab 1056 to close the holder box 1052.

Figure 25:
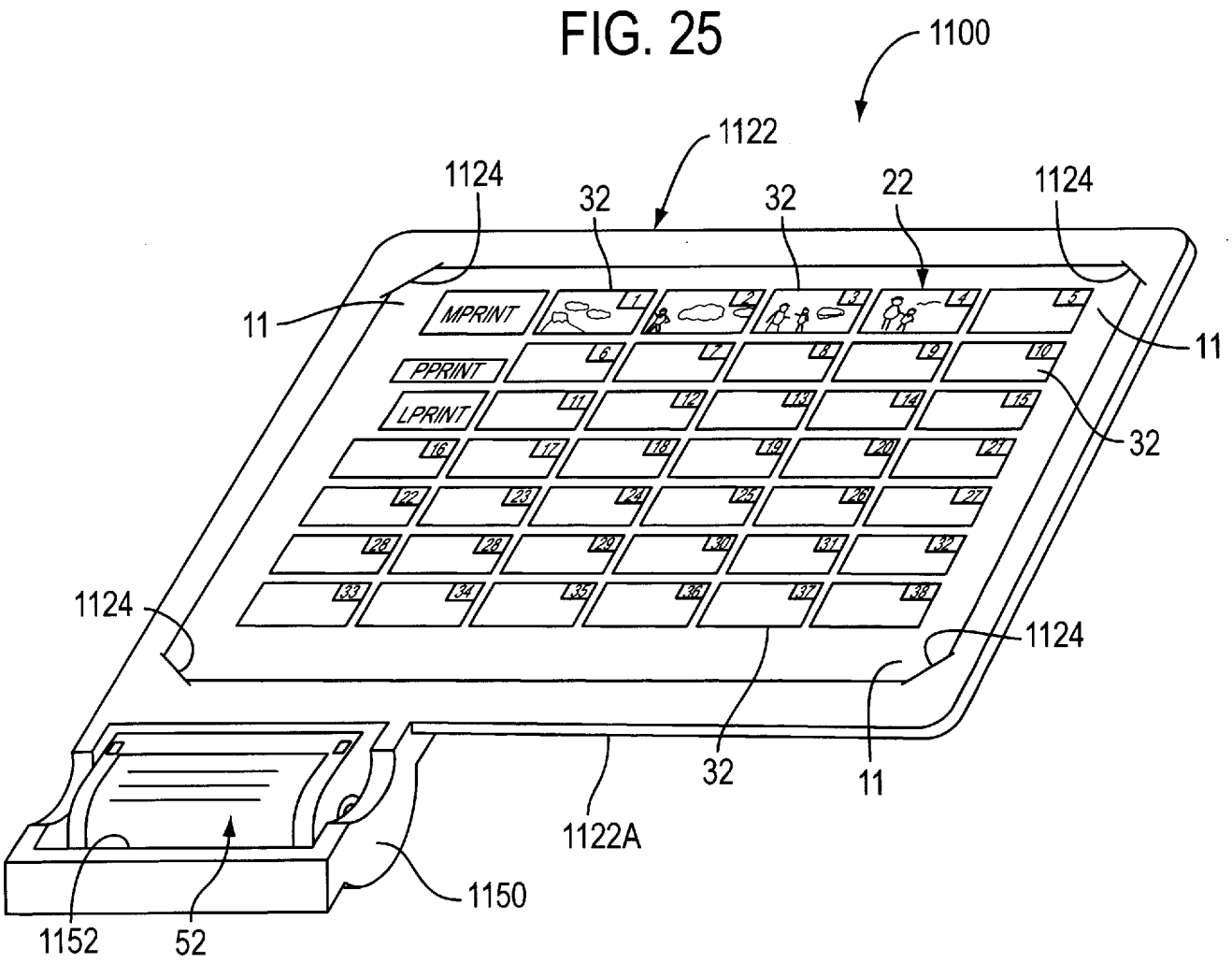
FIG. 25 is a perspective view of a mount sheet type of film and print organizer in accordance with another embodiment of the present invention as viewed from the back.

FIG. 25 shows a photographic film and print organizer 1100 according to another embodiment of the present invention. The photographic film and print organizer 1100 comprises an index print sheet mount 1122 and a cartridge holder 1150. The cartridge holder 1150 is formed as an integral part of the index print sheet mount 1122 at one end of the lower side 1122A and provided with a holding bed 1152 which conforms in shape with a film cartridge 52 to receive snugly and hold the film cartridge 52 therein. An index print sheet 22 with miniature pictures 32 is attached to the index print sheet mount 1122 with its four corners 11 inserted into the corner slits 1124.

Figure 27:
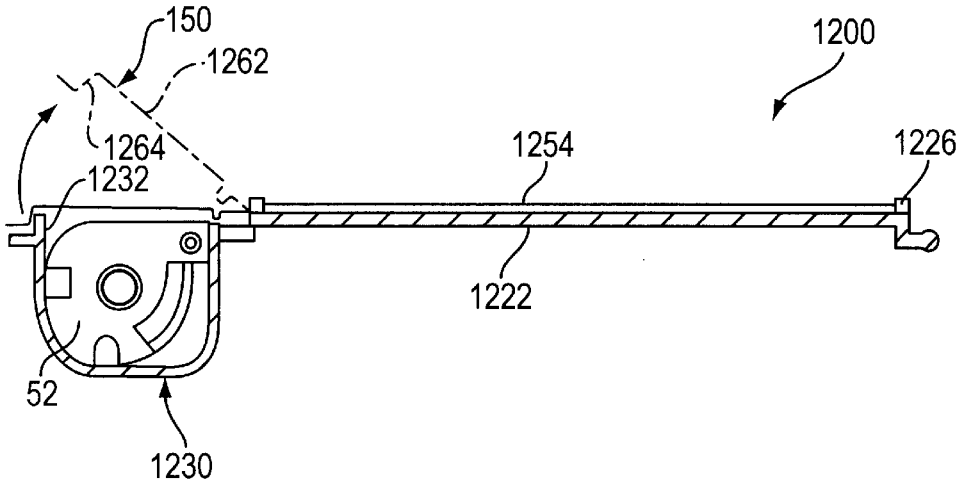
FIG. 27 is a cross-sectional view of the mount sheet type film and print organizer taken along line X—X of FIG. 26.

FIGS. 26 and 27 show a photographic film and print organizer 1200 according to another embodiment of the present invention. This photographic film and print organizer 1200 comprises a mount assembly 1210 and a frame assembly 1250. The mount assembly 1210 comprises an index print sheet mount 1222 and a box-shaped cartridge holder 1230 integrally formed with the index print sheet mount 1222. The frame assembly 1250 comprises a mount frame 1252 covered by a transparent sheet 1254 and a holder frame 1260 covered by a transparent sheet 1262. The mount frame 1250 is connected to the index print sheet mount 1222 by a hinge 1226. The holder frame 1260 is formed as an integral part of the index print sheet mount 1222 and connected to the index print sheet mount 1222 by a hinge 1232. An index print sheet (not shown) is placed between the index print sheet mount 1222 and the transparent sheet 1254. The cartridge holder 1230 is closed by the transparent sheet 1262 when the mount frame 1252 is placed in contact with the index print sheet mount 1222. Through the transparent sheets 1252 and 1262 an index print sheet and a film cartridge can be seen. As seen in FIG. 27, when the holder frame 1260 closes the cartridge holder 1230, a front shoulder 1264 of the holder frame 1260 fits to the upper edge 1232 of the cartridge holder 1230.

Figure 28:
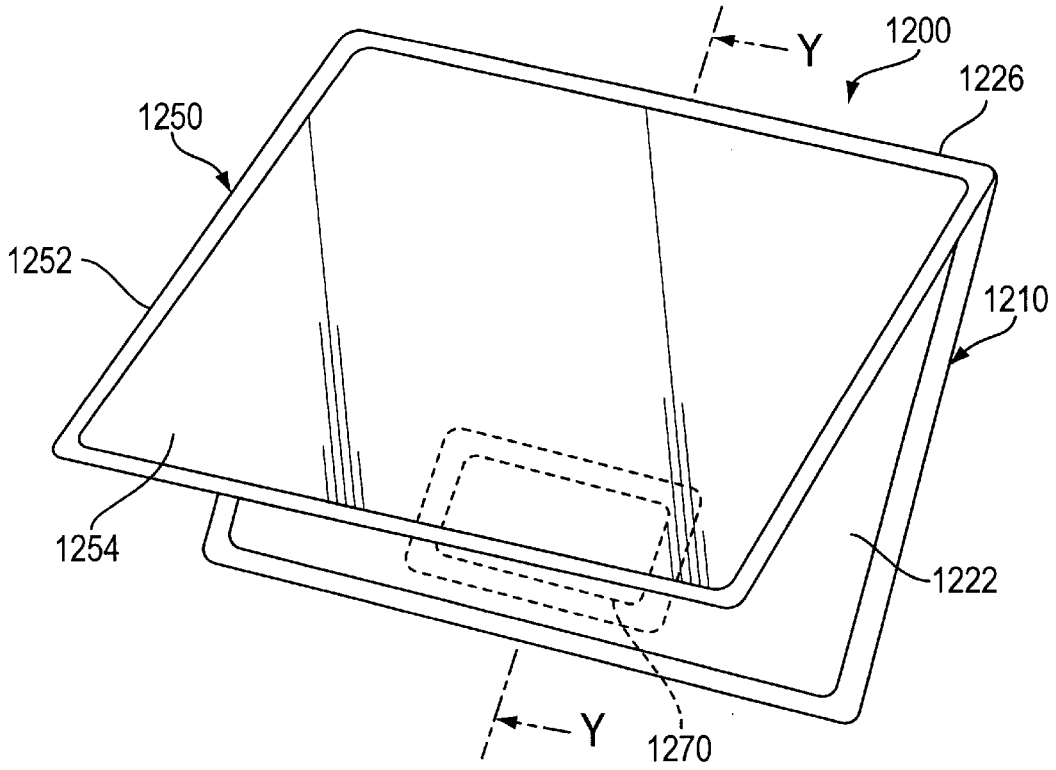
FIG. 28 is a perspective view of a mount sheet type of film and print organizer in accordance with another embodiment of the present invention.
Figure 29:
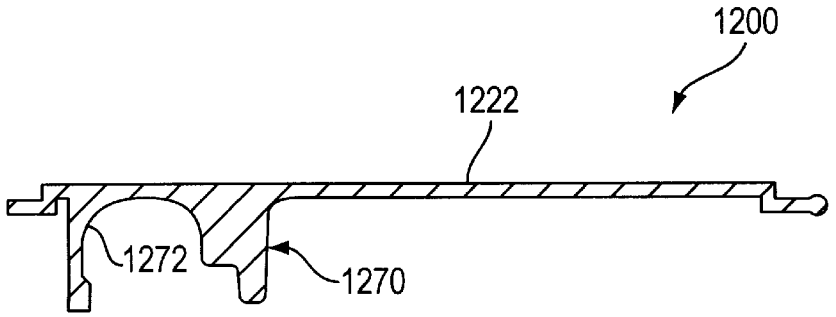
FIG. 29 is a cross-sectional view of the mount sheet type film and print organizer taken along line Y—Y of FIG. 28.

FIGS. 28 and 29 show a variant of the photographic film and print organizer 1200 which is provided with a box shaped cartridge holder 1270 secured to the back of the index print sheet mount 1222. The cartridge holder 1270 is made of elastic material to be expanded when a film cartridge is put in a cartridge seat 1272 and to be biased to restore its original shape, thereby holding the film cartridge. Since the film holder 1270 is attached to the back of the index print sheet mount 1222, the photographic film and print organizer 1200 has a simple front appearance.

Figure 30:
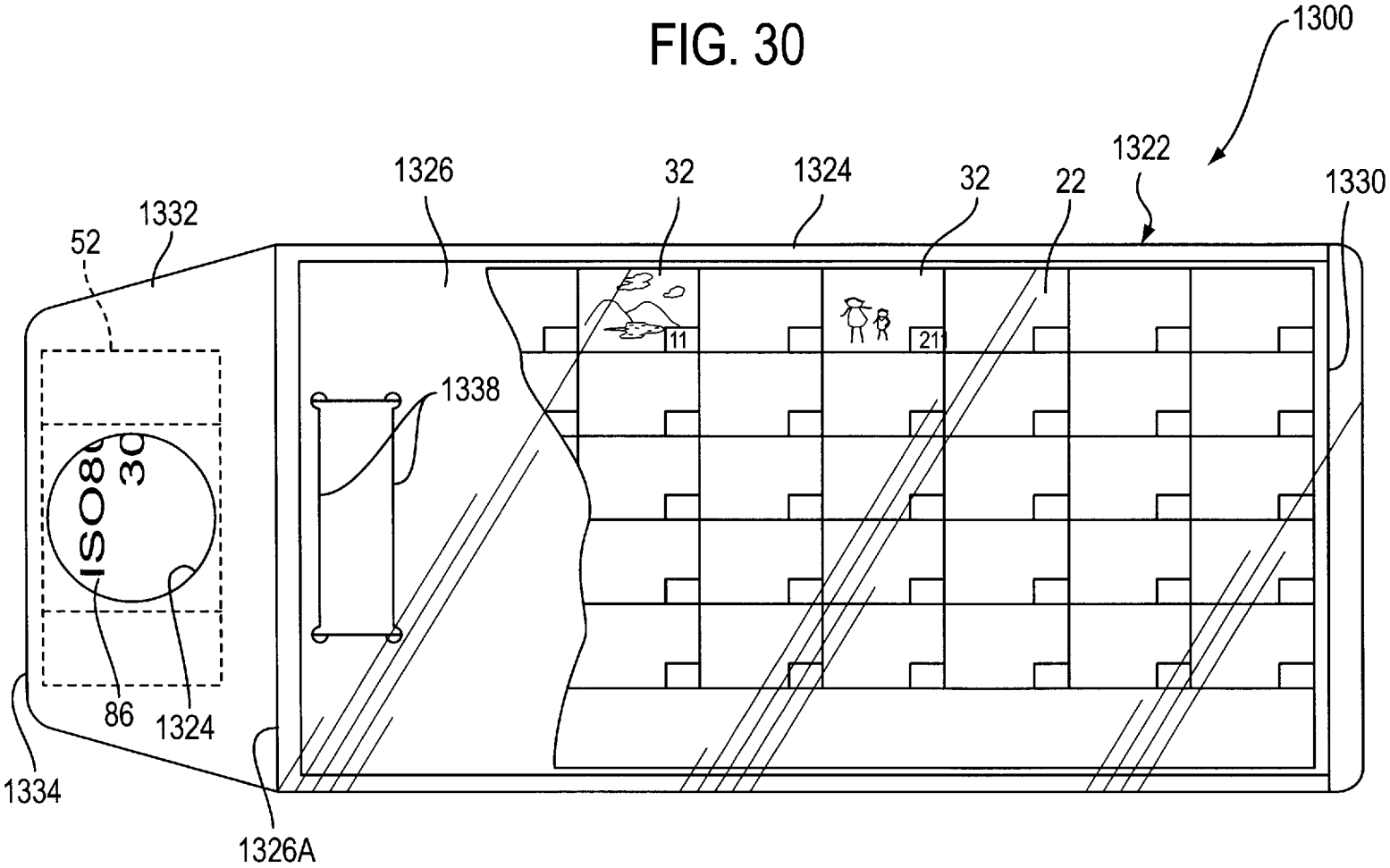
FIG. 30 is a plan view of a mount sheet type of film and print organizer in accordance with another embodiment of the present invention.
Figure 31:
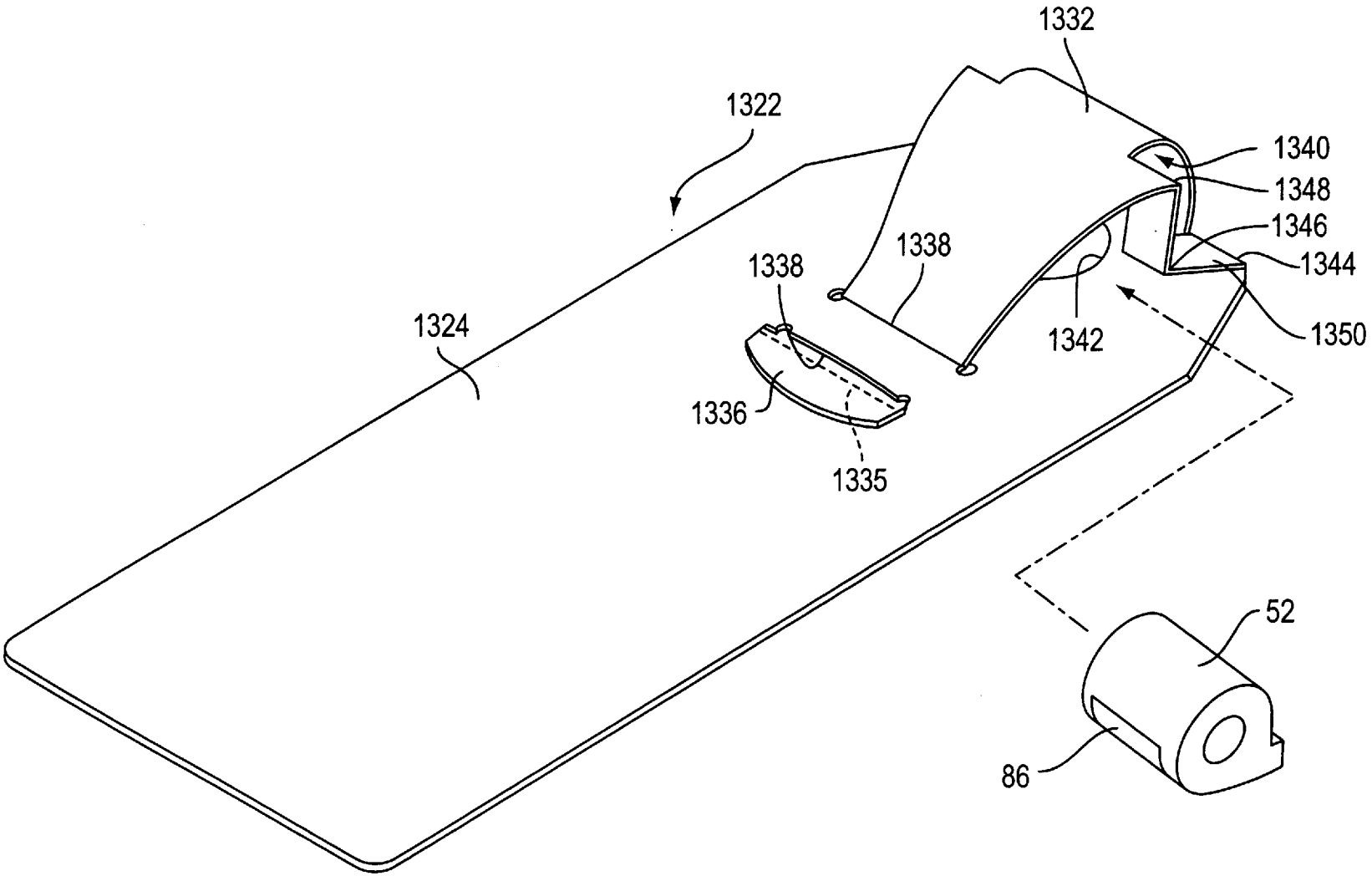
FIG. 31 is a perspective view of the mount sheet type film and print organizer of FIG. 30 as seen from the back.

FIGS. 30 and 31 show a photographic film and print organizer 1300 according to a further embodiment of the present invention. The photographic film and print organizer 1300 comprises an index print sheet mount 1322 and a cartridge holder 1350. The index print sheet mount 1322 comprises a rectangular paper mount 1324 and a transparent sheet 1326. The transparent sheet 1326 is sized in conformity with the rectangular paper mount 1324 and secured to it along three sides to form an opening 1330 at the remaining side. Through the opening 1330 an index print sheet 22, on which miniature pictures 32 are printed, is inserted and held between the rectangular paper mount 1324 and the transparent sheet 1326.

The rectangular paper mount 1324 is formed integrally with an end flap 1332 at one end 1326A opposite to the end where the opening 1330 is formed. The end flap 1332 is folded along a folding line 1334 and curved backward. The top strip 1336 is put into retainer slits 1338 formed in the rectangular paper mount 1324 from the back to form a cartridge holder 1340 as shown in FIG. 31. The end of the top strip 1336 may be folded back along a folding ling 1335 to prevent the top strip 1336 from slipping off from the retainer slits 1338. The end flap 1332 is formed with a see-through window 1342 to show the guide label 86 of a film cartridge 52 held by the cartridge holder 1340.

On the opposite sides of the see-through window 1342, the end flap 1332 is formed with folding lines 1344, 1346 and 1348. After putting a film cartridge 52 in the cartridge holder 1340, side retainers 1350 (only one of which is shown in FIG. 31) are folded downward to prevent the film cartridge 52 from slipping out of the cartridge holder 1340.

Figure 32:
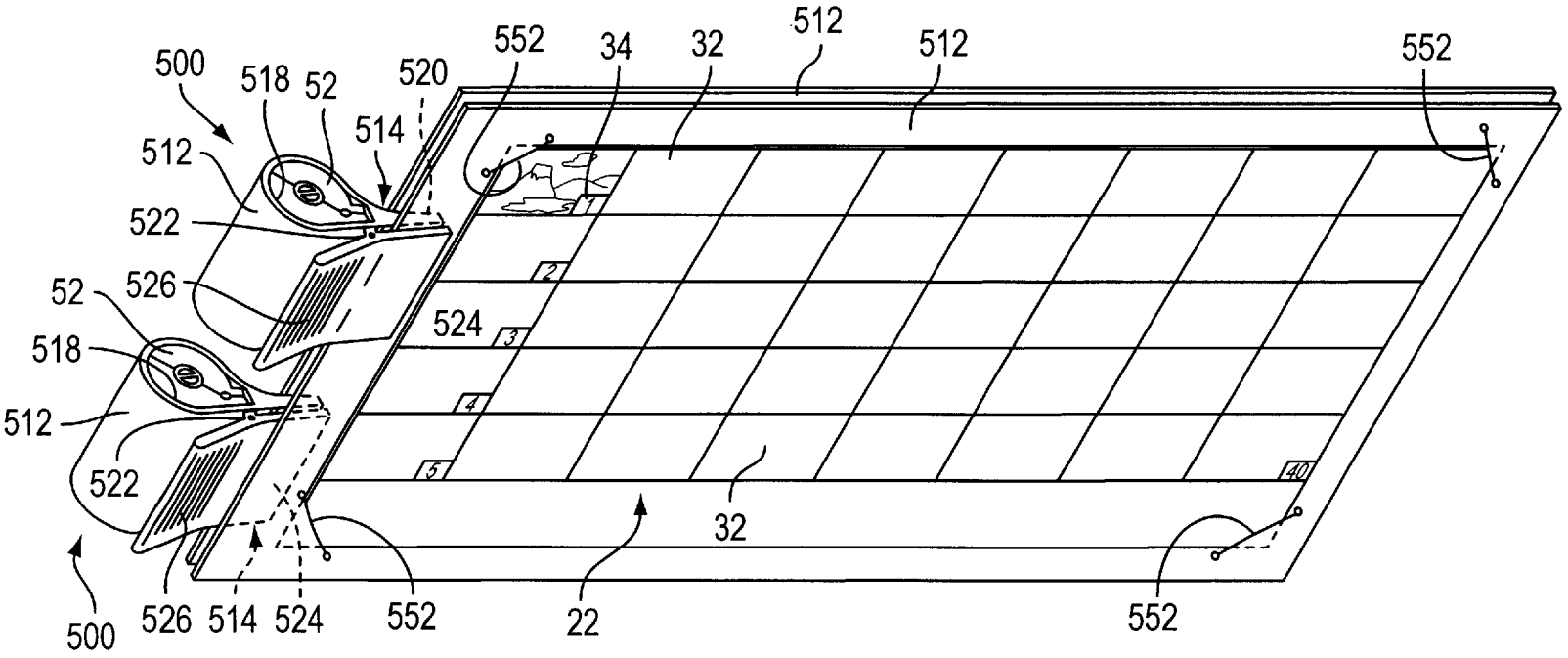
FIG. 32 is a plan view of a clip-on type of cartridge holder in accordance with another embodiment of the present invention which is used with a mount sheet type film and print organizer.

Referring to FIG. 32 showing a clip-on type of film cartridge holder 500 clipped on an index print sheet mount 512, the cartridge holder 500 comprises a holder body 512 and a clip 514. The holder body 512 is made of an elastic strip, such a plastic strip or a rubber strip, and is shaped to form a cylindrical space 518 for receiving a film cartridge 52 such as shown in FIG. 4. The clip 514 has a fixed claw end 520 integrally formed with and extending from the holder body 512 and a movable claw end 524 with a handle 526 which is mounted on a pivot 522 for pivotal movement. The claw ends 520 and 524 are urged by a spring (not shown) toward each other. While pushing the handle 526 and opening the claw ends 520 and 524, the clip nips the index print sheet mount 512.

The index print sheet mount 512, which is made of a rectangular plastic sheet or a rectangular cardboard sheet, is formed with corner slits 552 at for corners. An index print sheet 22 is placed on and held by the mount 512 with its corners inserted into the corner slits 552.

With the clip-on type of film cartridge holder 500, when a film cartridge 52 and an index print sheet 22 is returned from a photoshop, the customer attaches the index print sheet 22 onto the index print sheet mount 512. Subsequently, the customer can put the film cartridge 52 in the holder body 512 of the film cartridge holder 500 and attach the film cartridge holder 500 to the index print sheet mount 512 by making the claw ends nip the mount 512. In many instances where a pile of a plurality of the index print sheet mounts 512 is stored with one on top of another, the film cartridge holders 500 are attached to the mounts not to overlap one another but to be arranged side by side. This reduces the size of the pile. The combinations of the index print sheet mounts 512 and film cartridge holders 500 can thus be stored in a compact pile even when all of the index print sheet mounts 512 are placed with the correct side up. This saves storage space and facilities reference.

Figure 33:
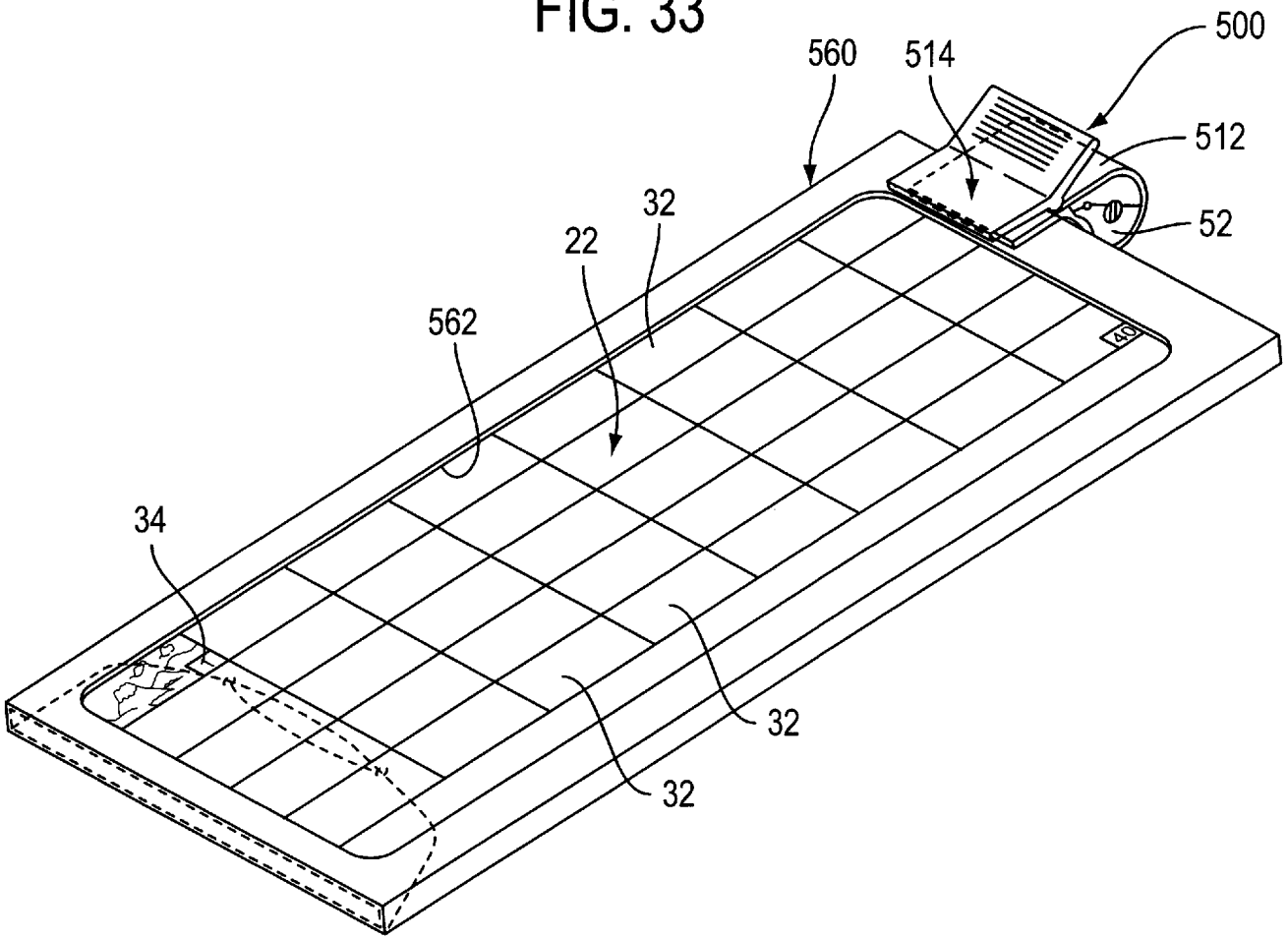
FIG. 33 is a perspective of the clip-on type cartridge holder of FIG. 32 which is used with an envelope type film and print organizer.

As shown in FIG. 33, the film cartridge holder 500 may be used in combination with an envelope type of receptacle 560 containing an index print sheet 22 and prints. The envelope type receptacle 560 is formed with a see-through window 562 preferably covered by a transparent sheet. The envelope type receptacle 560, which contains an index print sheet 22 and prints therein and the film cartridge holder 500 attached to the envelope type receptacle 560 are returned to the customer in the form of a photographic film and print organizer.

Figure 34:
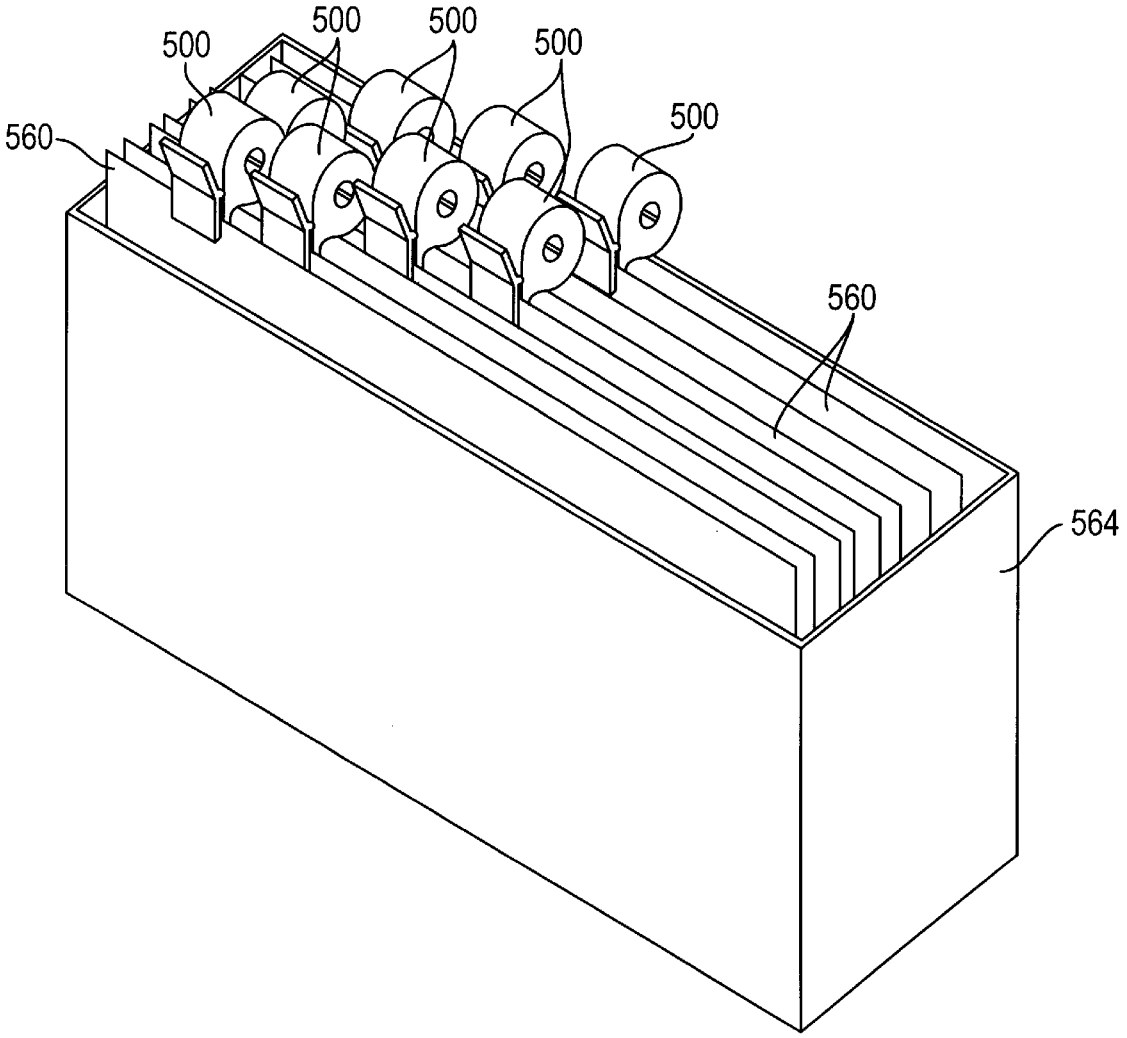
FIG. 34 is an illustration showing a number of the clip-on type cartridge holder attached to mount sheet type film and print organizers in a storage case.

The clip-on type film cartridge holder 500 is attached to a receptacle 560 at any location, facilitating storage and handling convenience at, in particular, photoshops. As shown in FIG. 34, a number of photographic film and print organizers comprising the clip-on type film cartridge holder 500 and receptacles 560 can be received in an orderly and compact manner in a storage box 564.

Figure 35:
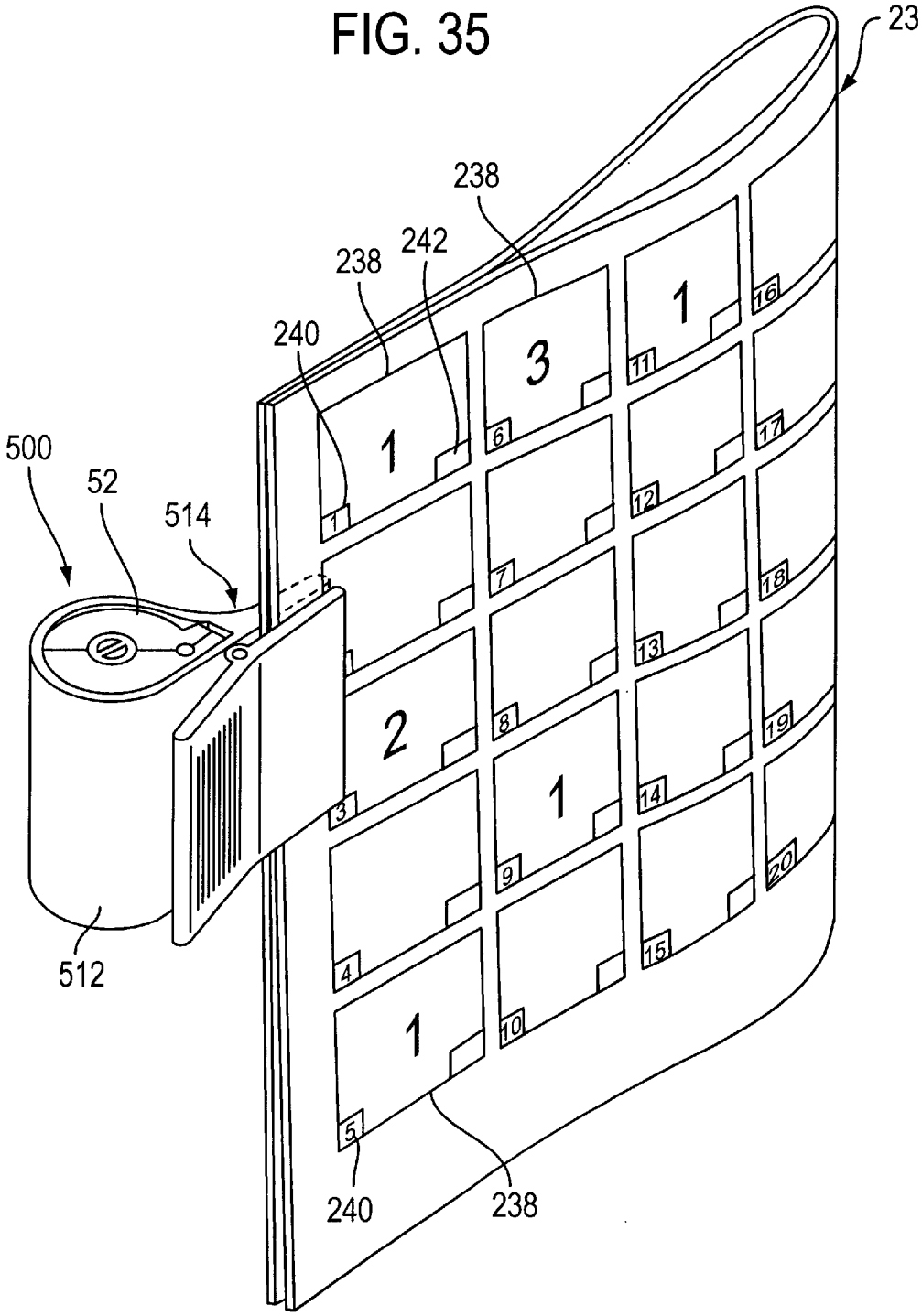
FIG. 35 is a perspective of the clip-on type cartridge holder of FIG. 32 which is used with a reorder form.

The clip-on type film cartridge holder 500 may be used further in combination with a re-order form 23 shown in FIG. 9. When there is a need for extra prints, the re-order form 23 is placed over an index print sheet 22, printed from a film which is in the film cartridge 52, kept by the clip-on type cartridge holder 500 and is filled with numbers of frames of the film for extra prints corresponding to the frame numbers of the index print. Thereafter, the clip-on type cartridge holder 500 is attached to the re-order form 23 as shown in FIG. 35 and is taken to a photoshop. The combined use of the clip-on type cartridge holder 500 and re-order form 23 makes it easy for the customer to order extra prints and for the photoshop to handle the film and extra prints. When the identification number printed on the film cartridge is marked on the re-order form as an order number, handling the extra prints and the film cartridge is convenient.

Figure 36:
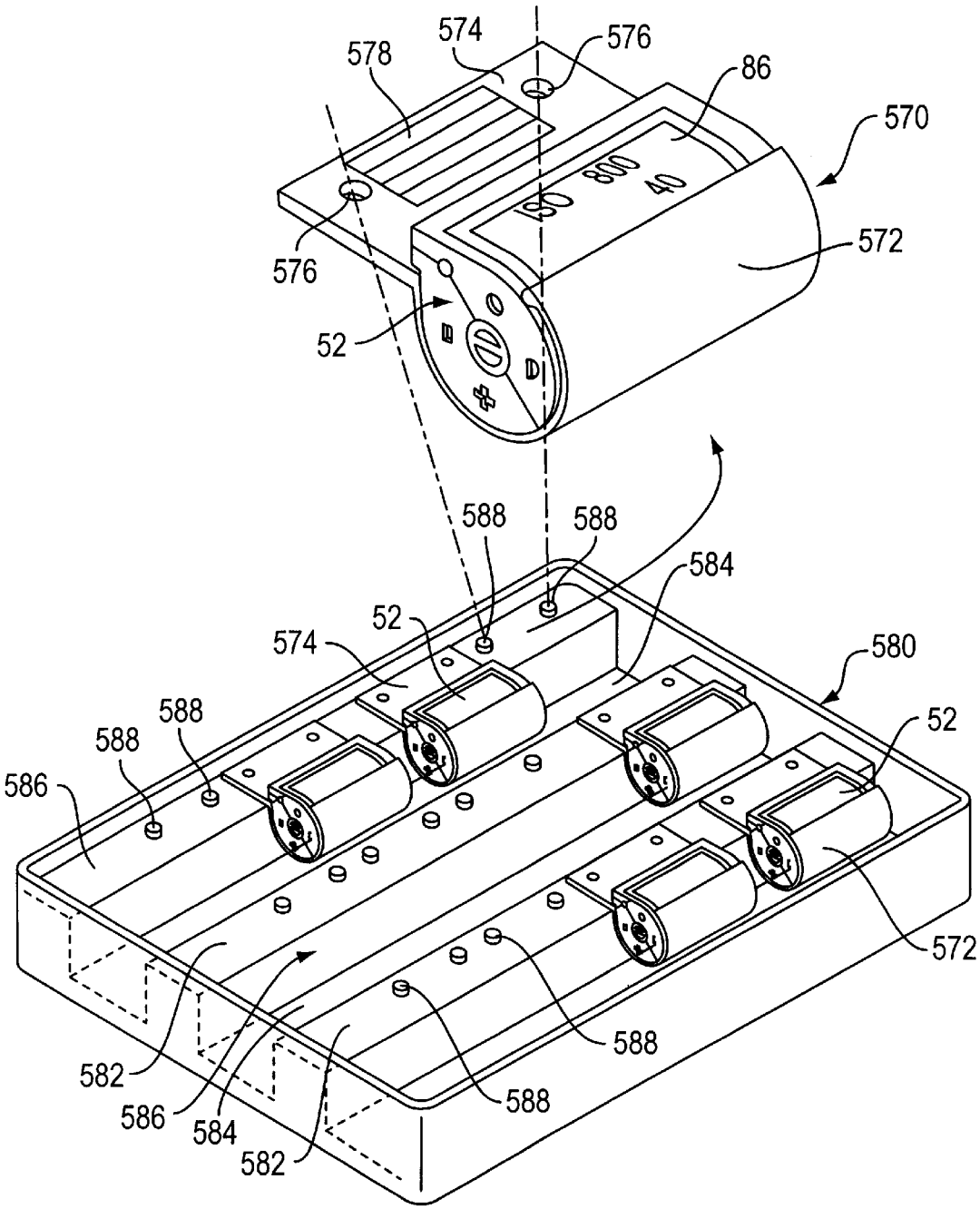
FIG. 36 is a perspective view of a cartridge holder in accordance with another embodiment of the present invention which is used with a mount sheet type film and print organizer and a cartridge storage case.

FIG. 36 shows a snap-on type film cartridge holder 570. The film cartridge holder 570 has a cartridge receptacle 572 having a generally C-shaped cross section and a flat extension 574. The cartridge holder 572 receives and holds a film cartridge 52 therein with a guide label 86 exposed. The flat extension 574 is formed with a pair of fitting holes 576 for firmly receiving bosses 588 of a storage box 580 which will be described later.

The storage box 580 includes a cartridge rack 582 having an alternative arrangement of a plurality of cartridge seating tracks 584 and a plurality of stools 586. Each of the stools 586 has a number of the fitting bosses 588 integrally formed therewith, or otherwise secured thereto, which are fit into the fitting holes of the flat extensions 574 of film cartridges 52. By fitting the bosses 588 into the holes 576 of the film cartridge holders 570 and seating the cartridge receptacles 572 in the tracks 584 of the cartridge rack 582, a number of film cartridges 52 held by the cartridge holder 572 are orderly stored in an array in the storage box 580. The fitting holes 576 and bosses 588 may be interchanged with each other.

A label 578 may be attached to the flat extension 574 of the cartridge holder 572. Information, such as date and locations of photography may be printed on the label 578 to make it easy to find the desired film cartridges 52 in the storage box 580.

Figure 37:
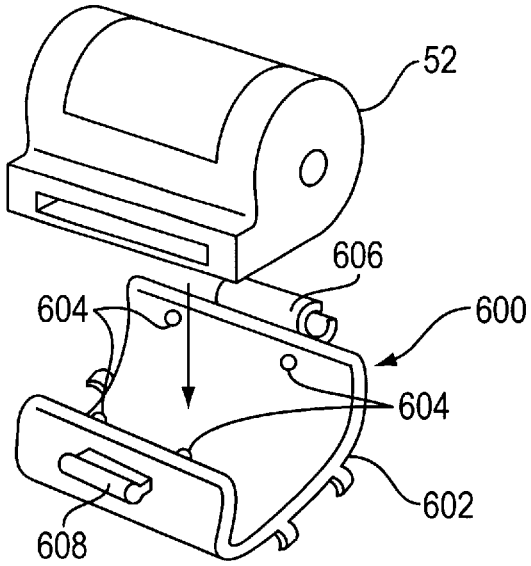
FIG. 37 is a perspective view of a cartridge holder in accordance with still another embodiment of the present invention.
Figure 38:
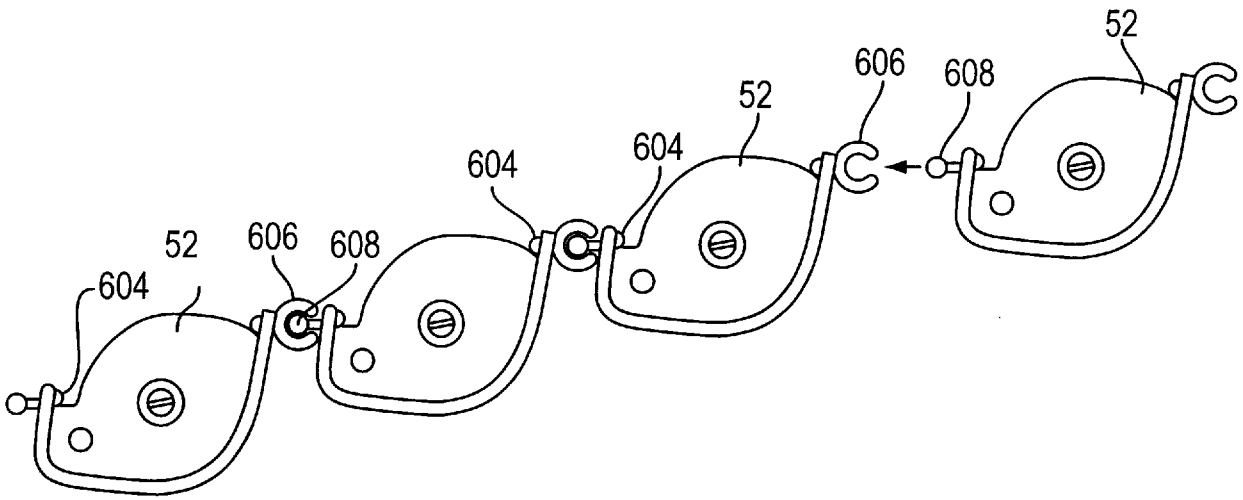
FIG. 38 is an illustration of a chain of the cartridge holder of FIG. 37.
Figure 39:
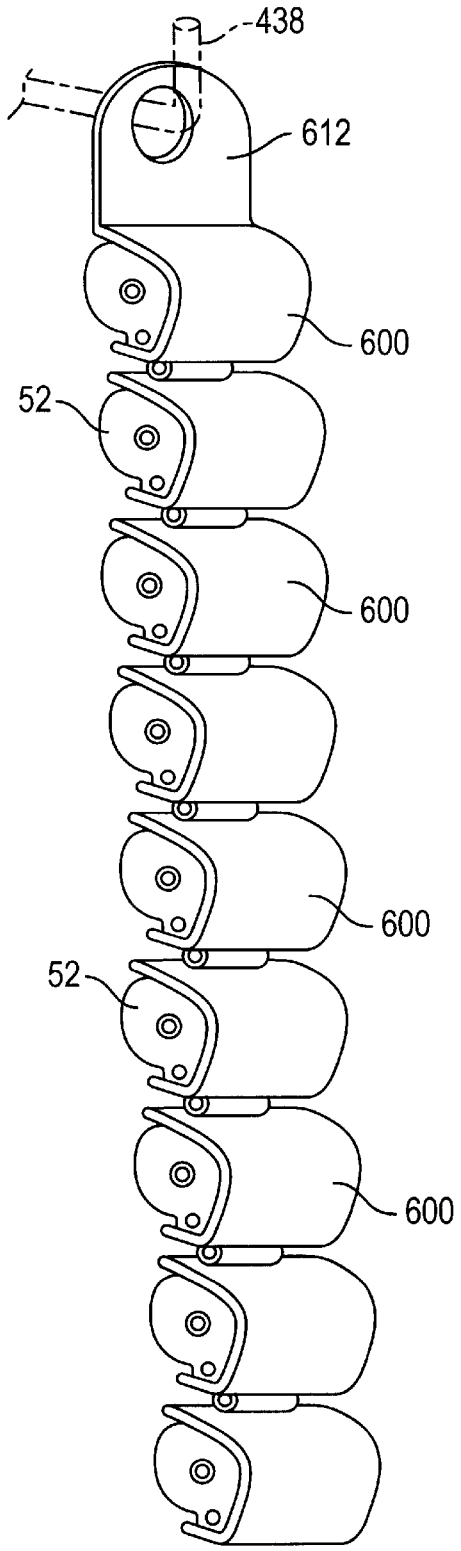
FIG. 39 is an illustration of a chain of the cartridge holder of FIG. 37.
Figure 40:
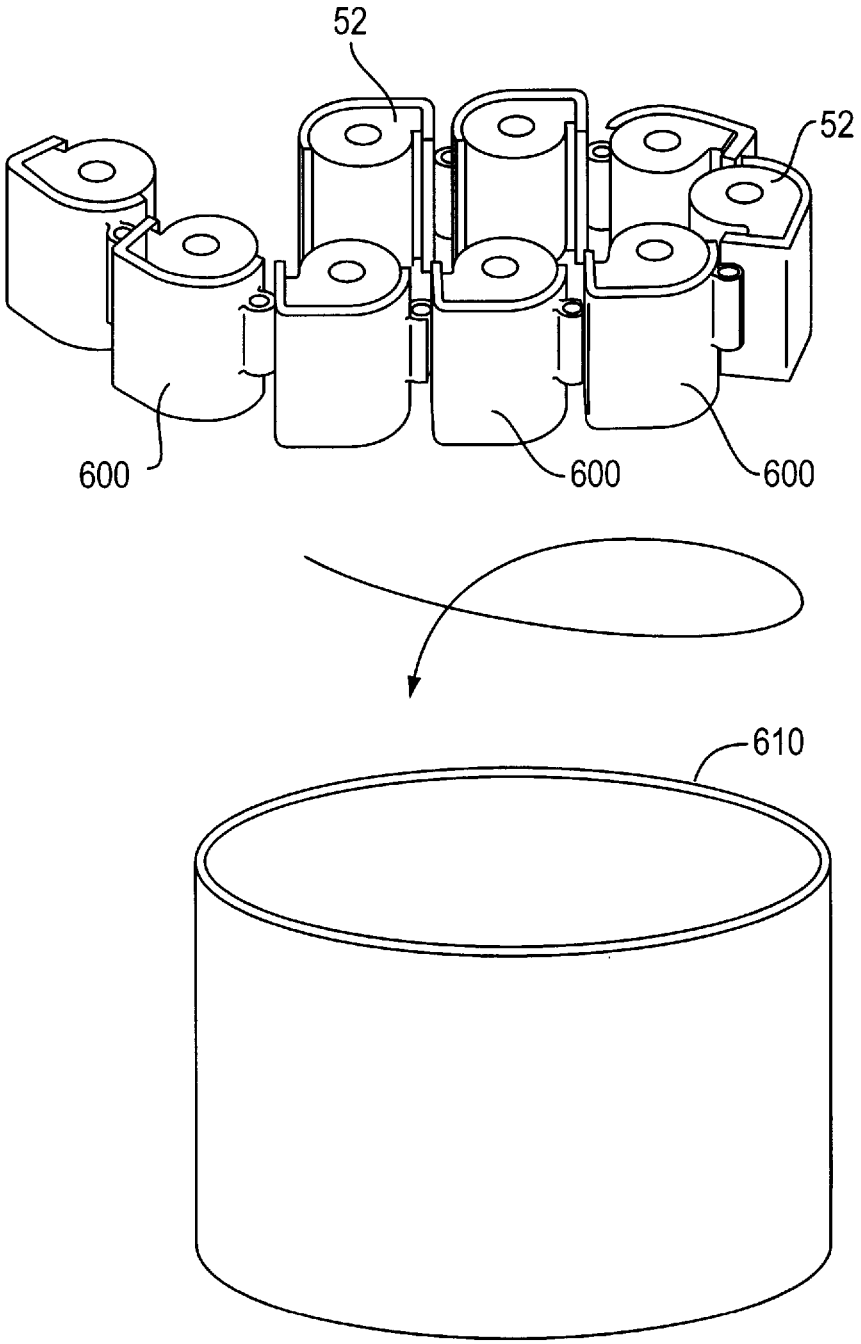
FIG. 40 is an illustration of a chain of the cartridge holder of FIG. 37 and a cartridge storage.

FIG. 37 shows a variant of the film cartridge holder. A film cartridge holder 600 comprises a receptacle 602 having a generally U-shaped cross section. The receptacle 602 is formed with retainer projections 604 on the inner surface for retaining a film cartridge 52 held therein and coupling means comprising a generally C-shaped hollow coupler head 606 and a rigid coupler head 608 having a shape complementary to the C-shaped coupler head 606, which are secured to opposite sides of the receptacle 602. Each rigid coupler head 608 of a cartridge holder 600 is coupled to the hollow coupler head 606 of another cartridge holder 600 so that the cartridges 600 are chained to each other. In this manner, a number of cartridge holders 600 can be chained to one another as shown in FIG. 38. A chain of a number of film cartridges 52 held by the cartridge holders 600 may be hung on a hanger bar 438 as shown in FIG. 39 for storage or display. For hanging a chain of film cartridges 52, an extra cartridge holder 600, which has a tab 612 formed with a hang-on hole 614, is used. Otherwise, a chain of a number of film cartridges 52 held by the cartridge holders 600 may be rolled up and stored in a cylindrical storage can 610 as shown in FIG. 40.

Figure 41:
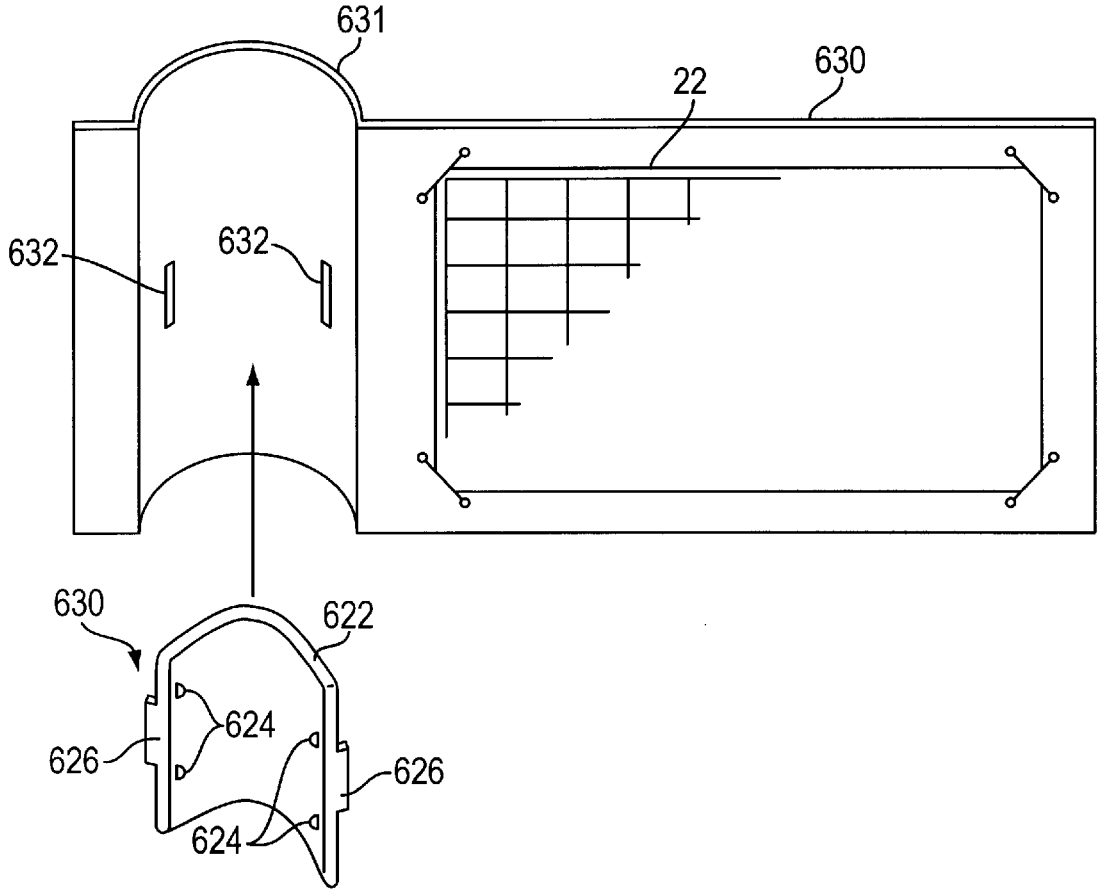
FIG. 41 is a perspective view of a cartridge holder in accordance with a further embodiment of the present invention which is used with a mount sheet type film and print organizer and a cartridge storage case.

FIG. 41 shows another combination of a cartridge holder 620 and a index print sheet mount 630. The cartridge holder 620 has a generally semi-circularly shaped receptacle 622. The receptacle 622 is integrally formed with retainer projections 624 on the inner surface at opposite sides for retaining a film cartridge (not shown) held therein and coupling means comprising a pair of connector tongues 626 on the outer surface at opposite sides. A film cartridge 52 (not shown) is retained by the retainer projections 624 of the receptacle 622 of the cartridge holder 620.

An index print sheet mount 630 is formed at its one end with a holder support 631 having a circular-arcuate cross section and provided with slots 632 for receiving the connector tongues 326 when the cartridge holder 620 is put on the holder support 631. The holder support 631 is configured to have a depth such that, when the cartridge holder 620 with a film cartridge 52 is received thereon, the upper surface of the film cartridge 52 is placed lower than or even with the surface of the index print sheet mount 630. The utilization of this film cartridge holder 620 in combination with the index print sheet mount 630 is quite convenient for storage of a film cartridge and an index print sheet 22 printed from a film in the film cartridge.

It is to be understood that although the present invention has been described with regard to preferred embodiments thereof, various other embodiments and variations may occur to those skilled in the art, which are within the scope and spirit of the invention, as defined by the following claims.

What is claimed is:

1. A photographic film and print organizer for carrying an index print sheet on which miniature pictures are printed from all frames of a roll of exposed and developed negative film, said miniature pictures being arranged in progressive order corresponding to a frame number of the roll of film, said organizer holding a film cartridge containing said roll of exposed and developed negative film and a plurality of prints of said exposed and developed negative film, said photographic film and print organizer comprising:

index print sheet carrying means for carrying said index print sheet thereon, comprising a front cover and a back cover separated by a hinge, wherein said front cover, said back cover and said hinge are integrally formed as a single unit;

retainer means for retaining said index print sheet on said index print sheet carrying means, said retainer means comprising retainer slits formed at four corners of one of said front cover and said back cover for receiving corners of said index print sheet to retain said index print sheet; and a cartridge holder integrally formed with said index print sheet carrying means for holding said film cartridge;

wherein one of said front cover and said back cover comprises integrally formed foldable flaps for holding said plurality of prints.

2. A photographic film and print organizer as defined in claim 1, wherein said index print sheet carrying means comprises a rectangular mount sheet.

3. A photographic film and print organizer as defined in claim 1, further comprising end retainer means for retaining said front and back covers in a closed position.

4. A photographic film and print organizer as defined in claim 3, wherein said end retainer means comprises a tuck tab integrally formed with one of said front and back covers and a retainer slit formed in the other of said front and back covers into which for retaining and preventing said cylindrical film cartridge from slipping out of said cylindrical space.

5. A photographic film and print organizer as defined in claim 2, wherein said cartridge holder comprises a box integrally formed on said rectangular mount sheet.

6. A photographic film and print organizer as defined in claim 1, wherein said hinge is a spine.

7. A photographic film and print organizer as defined in claim 1, wherein said cartridge holder is provided inside said spine.

8. A photographic film and print organizer as defined in claim 1, wherein said index print sheet carrying means is provided with an index marking spot.

9. A photographic film and print organizer for carrying an index print sheet on which miniature pictures are printed from all frames of a roll of exposed and developed negative film, said miniature pictures being arranged in progressive order corresponding to a frame number of the roll of film, said organizer holding a film cartridge containing said roll of exposed and developed negative film and a plurality of prints of said exposed and developed negative film, said photographic film and print organizer comprising:

index print sheet carrying means for carrying said index print sheet thereon, comprising a rectangular mount sheet;

retainer means for retaining said index print sheet on said index print sheet carrying means, said retainer means comprising a transparent sheet secured to said mount sheet along three sides of said mount sheet for receiving and retaining said index print sheet placed between said mount sheet and said transparent sheet; and a cartridge holder integrally formed with said index print sheet carrying means for holding said film cartridge, wherein said rectangular mount sheet comprises integrally formed foldable flaps for holding said plurality of prints.

* * * * *